US007446634B2

(12) United States Patent
Jeong et al.

(10) Patent No.: US 7,446,634 B2
(45) Date of Patent: Nov. 4, 2008

(54) MEMS SWITCH AND MANUFACTURING METHOD THEREOF

(75) Inventors: Hee-moon Jeong, Yongin-si (KR); Sang-wook Kwon, Seongnam-si (KR); Che-heung Kim, Yongin-si (KR); Jong-seok Kim, Hwaseong-si (KR); Jun-o Kim, Yongin-si (KR); Young-tack Hong, Suwon-si (KR); In-sang Song, Seoul (KR); Sang-hun Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 190 days.

(21) Appl. No.: 11/429,364

(22) Filed: May 8, 2006

(65) Prior Publication Data

US 2007/0018760 A1 Jan. 25, 2007

(30) Foreign Application Priority Data

Jul. 25, 2005 (KR) ..... 10-2005-0067333

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 6,069,540 | A | 5/2000 | Berenz et al. | |
| 6,720,851 | B2 * | 4/2004 | Hallbjorner et al. | 335/78 |
| 7,053,736 | B2 * | 5/2006 | Nelson | 335/70 |
| 2002/0140533 | A1 | 10/2002 | Miyazaki et al. | |

FOREIGN PATENT DOCUMENTS

| | | | |
|---|---|---|---|
| EP | 0 986 082 | A2 | 3/2000 |
| WO | WO 99/62089 | A1 | 12/1999 |

* cited by examiner

*Primary Examiner*—Anh Mai
*Assistant Examiner*—Bernard Rojas
(74) *Attorney, Agent, or Firm*—Sughrue Mion, PLLC

(57) ABSTRACT

A MEMS switch including a substrate at least one fixed electrode formed on top of the substrate and at least one restoring electrode formed on top of the substrate and formed at a lateral surface of the fixed electrode. At least one signal line is formed on top of the substrate and has a switching contact part. A movable electrode is distantly connected from the top of the substrate at a predetermined space via an elastic connector on the substrate and at least one contact member formed on a bottom surface of the movable electrode or on a bottom surface of the elastic connector for attachment to or detachment from the switching contact part. At least one pivot boss is formed on either the bottom surface of the movable electrode or on the top of the substrate.

31 Claims, 23 Drawing Sheets

MEMS SWITCH AND MANUFACTURING METHOD THEREOF

CROSS-REFERENCE TO RELATED APPLICATIONS

This application claims benefit under 35 U.S.C. § 119(a) of Korean Patent Application No. 2005-67333, filed on Jul. 25, 2005, the entire contents of which are incorporated herein by reference.

BACKGROUND OF THE INVENTION

1. Field of the Invention

The present invention relates to a Micro Electro Mechanical System (MEMS) switch and a manufacturing method thereof.

2. Description of the Related Art

Electronic systems used at a high frequency band are becoming ultra-compact, ultra-light and better in performance. Accordingly, in the existing electronic system, researches are ongoing on a micro switch using a new technology called a micromachining as a substitute for a semiconductor switch such as an FET (Field Effect Transistor) or a PIN diode.

The most widely manufactured device out of Radio Frequency (RF) devices using the MEMS technology is a switch.

The RF switch is a device widely applied for selective transmission of signals and impedance matching circuits in wireless communication terminals of microwave or millimeter wave bands and systems thereof.

FIG. 1 is a side view illustrating structure of a seesaw type MEMS switch according to the prior art, and FIGS. 2A and 2B are operational constitutional representations illustrating a state where the switch of FIG. 1 is operating.

Referring to FIG. 1, a conventional MEMS switch 1 is disposed in a seesaw-like structure at a top of a substrate 2, spaced a predetermined distance apart, with a movable electrode 3 via a spring arm 5.

The movable electrode 3 is formed at least one end thereof with a contact member 7, and a signal line 9 is formed on top of the substrate 2 with respect to a location opposite to the contact member 7.

A fixed electrode 11 is formed on top of the substrate 2 for generating an electrostatic force along with the movable electrode 3 and for contacting the contact member 7 to the signal line 9, and the other end of the fixed electrode 11 is formed with a restoring electrode 13 for distancing one end of the movable electrode 3 provided with the contact member 7 from the substrate 2.

Referring to FIG. 2A, if a voltage is applied to the fixed electrode 11 in the conventional MEMS switch 1, an electric charge is generated therebetween, and the movable electrode 3 is rotated clockwise about the spring arm 5 by the electrostatic force to cause the contact member 7 provided at the bottom of the movable electrode 3 to contact the signal line 9.

Referring now to FIG. 2B, if a voltage is applied to the restoring electrode 13 by releasing the voltage of the fixed electrode 11, the movable electrode 3 is rotated counterclockwise about the spring arm 5 to cause the contact member 7 to distance from the signal line 9.

The seesaw-type MEMS switch thus described has an advantage in that the restoring force can be increased by embodying on a same planar surface a restoring part using the electrostatic force for easy MEMS process, in addition to the restoring force by a mechanical spring compared with an existing planar type switch (a membrane type where the entire movable electrode is fixed with respect to the substrate).

However, there is a disadvantage in that, because the movable electrode 3 is inclined at a predetermined degree (θ°) as illustrated in FIG. 2A when the contact member 7 contacts the signal line 9, the contact force of the contact member 7 becomes relatively decreased due to inefficiency of electrode gap with respect to planar type, resulting in increase of driving voltage.

There is another disadvantage in that when the contact member 7 and the signal line 9 are brought into contact, a distance (L) from the substrate 2 to an opposite end of the contact member 7 is lengthened, resulting in increase of the restoring voltage for restoring the movable electrode 3.

SUMMARY OF THE INVENTION

An aspect of the present invention is to solve at least the above disadvantages and to provide at least the advantages described below. Accordingly, it is one aspect of the present invention to provide a MEMS switch configured to improve a seesawed rotational structure of a movable electrode, thereby increasing the contact force of the contact member, to improve the restoring force and to lower an initial pull-in voltage.

It is another aspect of the present invention to provide manufacturing method of the MEMS switch thus described.

In accordance with one exemplary embodiment of the present invention, there is provided a MEMS switch comprising: a substrate; at least one fixed electrode formed on top of the substrate; at least one restoring electrode formed on top of the substrate and formed at a lateral surface of the fixed electrode; at least one signal line formed on top of the substrate and having a switching contact part; a movable electrode distantly connected from the top of the substrate at a predetermined space via an elastic connector on the substrate; at least one contact member formed on a bottom surface of the movable electrode or on a bottom surface of the elastic connector for attachment to or detachment from the switching contact part; and at least one pivot boss formed on either the bottom surface of the movable electrode or on the top of the substrate.

The elastic connector may comprise: a movable frame constituting a pair of beams, each spaced a predetermined distance apart, and interposing the movable electrode therebetween; a first elastic member for connecting one end of the beams to the substrate; and a second elastic member connecting a distal end of the movable electrode interposed in the pair of beams to the other end of the beams.

The pivot boss may be formed on the bottom surface of the movable electrode.

The fixed electrode and the restoring electrode may further comprise an insulation layer thereon.

The insulation layer may be SiN or $SiO_2$.

The fixed electrode, the restoring electrode and/or the signal line may constitute Au.

The contact member may comprise: a contact insulation layer formed on the bottom surface of the movable electrode or the bottom surface of the movable frame; and a contact conductive layer formed on a bottom surface of the contact insulation layer.

The contact insulation layer may be SiN or $SiO_2$, and the contact conductive layer may be Au.

The pivot boss may be formed between the fixed electrode and the restoring electrode with respect to the bottom of the movable electrode, and is formed in pairs in parallel with the signal line.

The contact member may be provided at a distal end of the movable electrode and the contact member may be disposed as to be rocked by a spring arm formed at a rotational axis toward a direction crossing the signal line.

The elastic connector may comprise: a movable frame disposed therein with the movable electrode and having a square frame for protruding one end of the movable electrode; a first elastic member connecting one end of the movable frame to the substrate; and a second elastic member connecting one end of the movable electrode disposed inside the movable frame to the movable frame.

The contact member may be provided on the bottom surface of the movable frame, or on the bottom surface of the movable electrode.

In accordance with another exemplary embodiment of the present invention, there is provided a MEMS switch comprising: a lower substrate formed thereon with a bottom electrode groove, and formed with at least one fixed electrode, a restoring electrode and a signal line having a signal contact part on the bottom electrode groove; a top substrate including a movable frame traversing the fixed electrode and the restoring electrode, a first elastic member connected at one end thereof to one end of the movable frame and connected at the other end thereof to one side of the top substrate, a second elastic member formed at the other side of the movable frame, and a movable electrode connected to the second elastic member and relatively rotating inside the movable frame, being integrally formed with the movable frame, the first elastic member, the second elastic member, and the movable electrode, and contacting a top surface of the lower substrate corresponding to a periphery of the bottom electrode groove; a contact member formed at a bottom surface of the movable frame; and a pivot boss formed at an approximate center of the movable electrode.

The lower substrate may be made of glass.

The top substrate may be made of silicon.

The fixed electrode, the restoring electrode and/or the signal line may be made of Au.

The fixed electrode and the restoring electrode may further comprise thereon an insulation layer, and the insulation layer is formed with SiN layer or $SiO_2$ layer.

The contact member may comprise: a contact insulation layer formed on a bottom surface of the movable electrode; and a contact conductive layer formed on a bottom surface of the contact insulation layer, and the contact insulation layer may be SiN layer or $SiO_2$ layer, and the contact conductive layer may be formed with Au.

The movable electrode may be provided at a distal end thereof with a contact part having a size corresponding to that of the contact member, and the contact part may be rotatably connected to a distal end of the movable electrode by a spring arm.

The first elastic member and the second elastic member are serpentine in shape.

In accordance with still another exemplary embodiment of the present invention, a manufacturing method of MEMS switch comprises: forming a bottom electrode groove having a predetermined gap on a lower substrate; forming at least one fixed electrode, at least one restoring electrode and at least one signal line having a signal contact part on a top surface of the bottom electrode groove; forming a contact member and a pivot boss on a lower surface of a top substrate; bonding the top substrate formed with the contact member and the pivot boss to a top surface of the lower substrate; and integrally forming a first elastic member, a movable frame, a second elastic member and a movable electrode on the top substrate bonded to the top surface of the lower substrate.

The lower substrate may be made of glass, and the fixed electrode, the restoring electrode and/or the signal line are made of Au, and the top substrate is a silicon substrate.

In the aforementioned step of integrally forming the first elastic member, the movable frame, the second elastic member and the movable electrode on the top substrate further comprises: forming a contact part formed with the contact member, and forming a spring arm hinge-fixing the contact part.

The first and second elastic members may be serpentine in shape.

BRIEF DESCRIPTION OF THE DRAWINGS

The above aspect and other features of the present invention will become more apparent by describing in detail exemplary embodiments thereof with reference to the attached drawings, wherein.

DETAILED DESCRIPTION OF THE EXEMPLARY EMBODIMENTS

Figure 1:
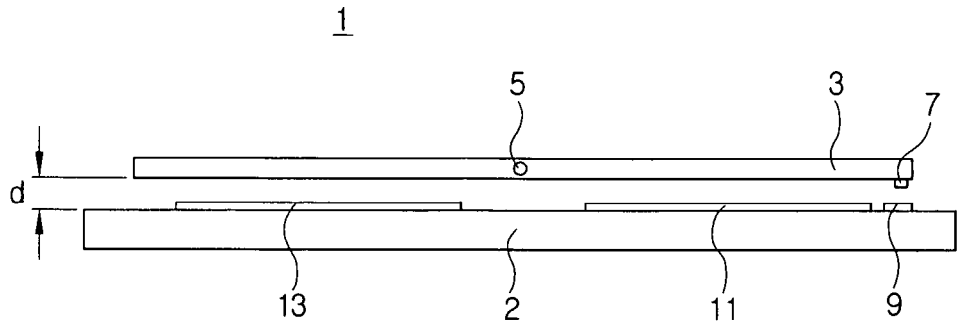
FIG. 1 (PRIOR ART)
FIG. 1 is a lateral view illustrating structure of a MEMS switch according to the prior art.
Figure 2A:
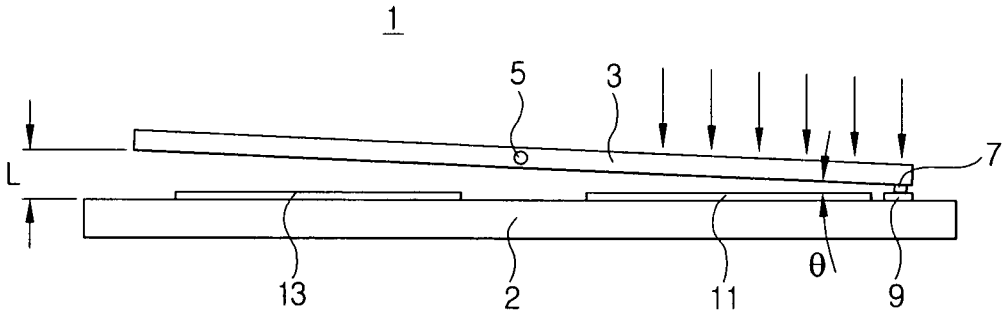
FIG. 2A (PRIOR ART)
FIGS. 2A and 2B illustrate an operational state in which a switch of FIG. 1 is operating.
Figure 2B:
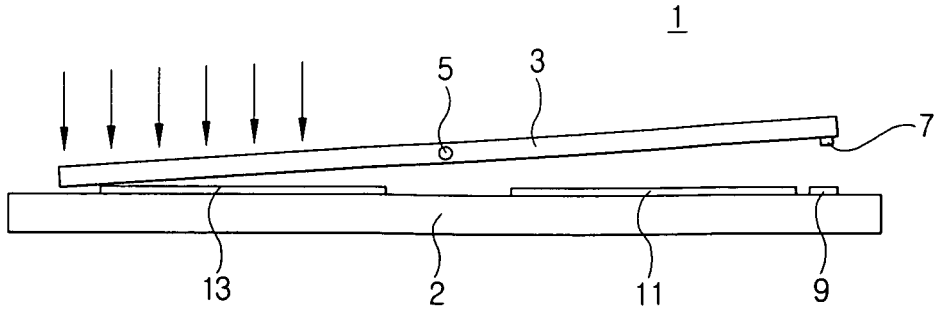
FIG. 2B (PRIOR ART)

Hereinafter, exemplary embodiments of the present invention will be described in detail with reference to the accompanying drawings.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 26:
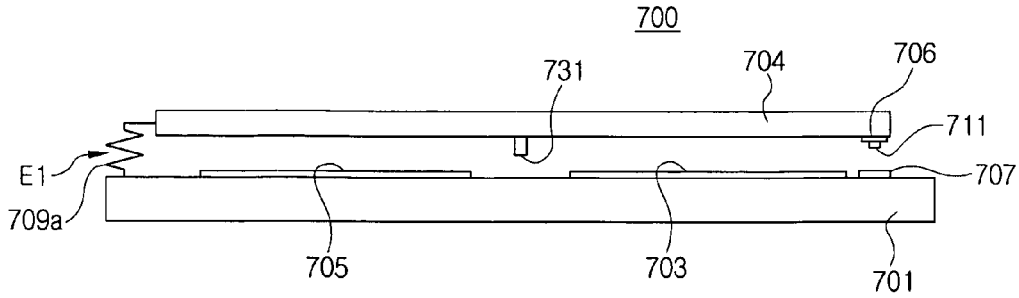
FIG. 26 is a lateral view illustrating a structure of a MEMS switch according to an exemplary embodiment of the present invention.

FIG. 26 is a lateral view illustrating a structure of a MEMS switch according to an exemplary embodiment of the present invention.

Referring to FIG. 26, a MEMS switch 700 includes a substrate 701, a fixed electrode 703, a restoring electrode 705, a signal line 707, a movable electrode 704, an elastic connector (E1) and a pivot boss 731.

To be more specific, the substrate 701 is formed at a top thereon with the fixed electrode 703 and the restoring electrode 705 each spaced a predetermined distance apart and in parallel, and is also formed with the signal line 707.

The movable electrode 704 is mounted a predetermined distance apart from the top of the substrate via a spring member 709*a* which is an elastic connector (E1).

The movable electrode 704 is formed at a central bottom surface, i.e., at an area between the fixed electrode 703 and the restoring electrode 705, with a pivot boss 731.

Furthermore, the movable electrode 704 is formed at an end thereof with a contact member 711 contacting the signal line 707, where the pivot boss 731 may be formed on the top of the substrate 701.

In the aforementioned structure, an insulation layer 706 may be further formed between the contact member 711 and the movable electrode 704.

An insulation layer (not shown) may be further formed between the movable electrode 704, the fixed electrode 703 and the restoring electrode 705.

Next, an operational principle of a MEMS switch according to an exemplary embodiment of the present invention will be described with reference to FIGS. 27A through 27C.

Figure 27A:
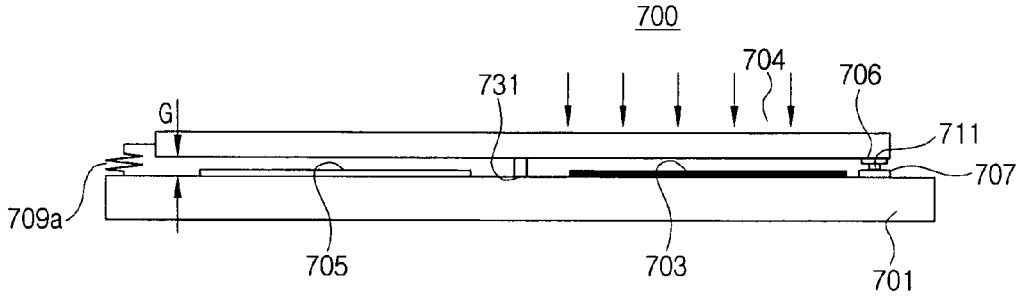
FIGS. 27A through 27C are representations illustrating an operation principle of FIG. 26.
Figure 27B:
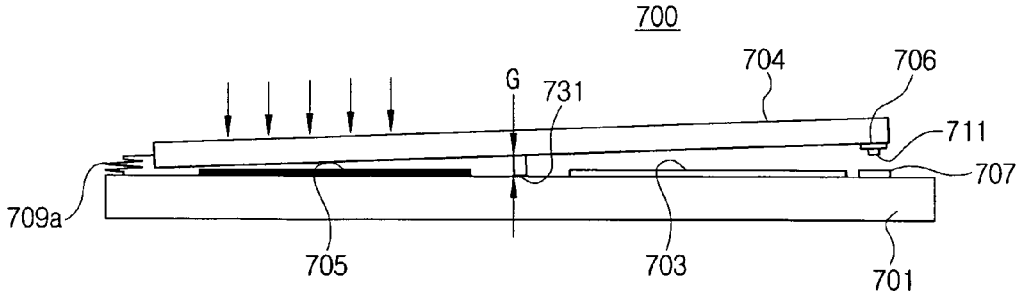
Figure 27C:
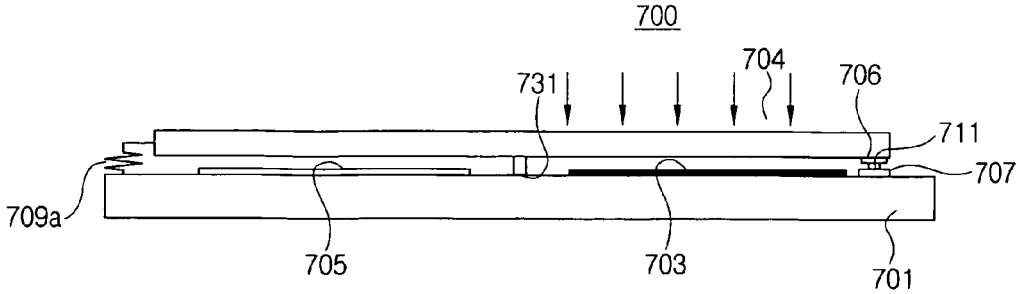

FIGS. 27A through 27C are representations illustrating an operation principle of FIG. 26.

Referring to FIG. 27A, if a voltage is applied to the fixed electrode 703, an electric charge is generated between the fixed electrode 703 and the movable electrode 704, and the movable electrode 704 is pulled to a substrate 701 side by electrostatic attraction.

As a result, the spring member 709*a* which is an elastic connector (E1) is contracted, and the contact member 711 provided at a lower surface of the movable electrode 704 is brought into contact with the signal line 707, and the pivot boss 731 contacts a top surface of the substrate 701.

The contact member 711 contact just like a planar switch of the prior art to improve the contact force.

Now, referring to FIG. 27B, if the voltage of the fixed electrode 703 is blocked, and a restoring voltage is applied to the restoring electrode 705, the movable electrode 704 is rotated counterclockwise about the pivot boss 731 and the contact member 711 is disconnected from the signal line 707.

At this time, restoring force can be further improved compared with that of the prior art because the height of the pivot boss 731 constitutes a bit of gap (G) from the top surface of the substrate 101.

Therefore, a restoring voltage consumption rate for restoring the movable electrode 704 is reduced.

Referring to FIG. 27C, if the voltage is again applied to the fixed electrode 703, the movable electrode 704 is rotated clockwise about the pivot boss 731 to cause the contact member 711 to contact the signal line 707.

According to the exemplary embodiment of the present invention thus described, there is no need of reaction caused by a mechanical spring when a switch is turned on and off by electrostatic force and the pivot boss 731 is immediately responded to an axis such that a switching speed is very fast.

As a result, an initial pull-in voltage can be reduced by weakening the strength of the spring member 709*a* which is an elastic connector (E1).

First Embodiment

Figure 3:
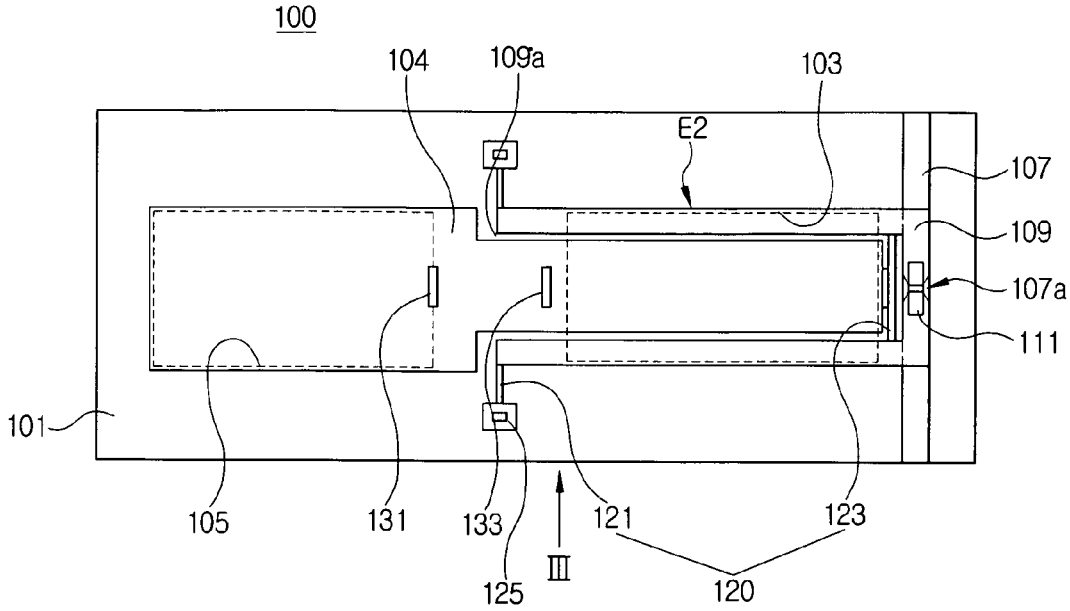
FIG. 3 is plan view illustrating a structure of a MEMS switch according to an exemplary embodiment of the present invention.
Figure 4:
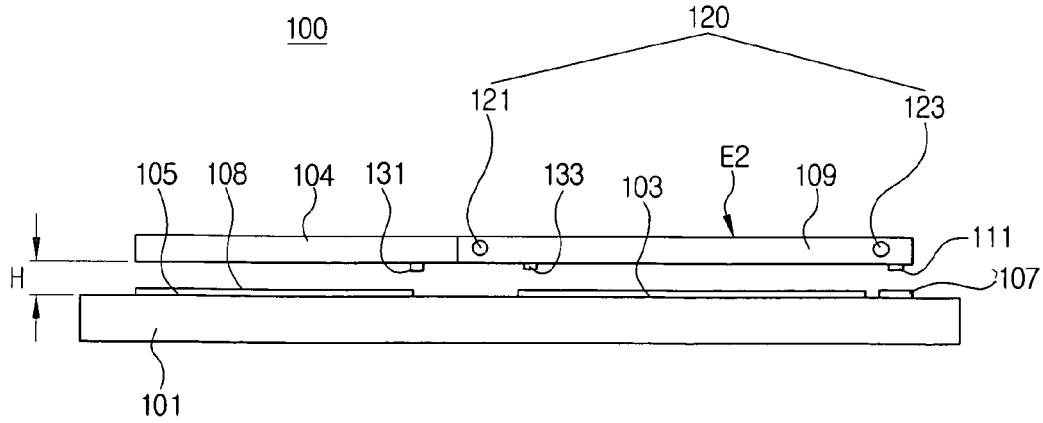
FIG. 4 is a lateral view taken along an arrow III of FIG. 3.

FIG. 3 is plan view illustrating a structure of a MEMS switch according to an exemplary embodiment of the present invention, and FIG. 4 is a lateral view taken along an arrow III of FIG. 3.

Referring to FIGS. 3 and 4, a MEMS switch 100 includes a substrate 101, a fixed electrode 103, a restoring electrode 105, a signal line 107, a movable electrode 104, an elastic connector (E2) and pivot bosses 131 and 133.

The substrate 101 is formed thereon with the fixed electrode 103 and the restoring electrode 105 is formed in parallel with the fixed electrode 103.

The fixed electrode 103 and the restoring electrode 105 are not fixed in location thereof such that their location may be changed according to location of a contact member 111.

The signal line 107 is formed with a signal contact part 107*a* formed a predetermined distance apart therefrom.

The fixed electrode 103, the restoring electrode 105 and signal line 107 are made of conductive material, for example, Au.

The fixed electrode 103 and the restoring electrode 105 may be further formed thereon with an insulation layer (not shown).

The elastic connector (E2) includes a movable frame 109 and an elastic support unit 120.

The movable frame 109 has a rectangular shape opened at one side thereof, and is also provided at a bottom surface with the contact member 111. The contact member 111 is attached to or detached from a contact part 107*a* of the signal line 107 in response to the movable operation of the movable frame 109.

The elastic support unit 120 includes a first elastic member 121 rotatably supporting the movable frame 109 on the substrate 101, and a second elastic member 123 relatively working the movable electrode 104 with respect to the movable frame 109.

The first elastic member 121 is connected to both sides of one end of the movable frame 109, and is situated approximately in between the fixed electrode 103 and the restoring electrode 105.

In order to detach the movable frame 109 from the top surface of the substrate 101 at a predetermined gap (H), an anchor 125 is provided on the substrate 101 and the first elastic member 121 is connected to the anchor 125.

The second elastic member 123 is connected to an inside of an end opposite to the movable frame 109 connected to the first elastic member 121, and is connected to an end of the movable electrode 104.

The movable electrode 104 is rotatable relative to an inside end of the movable frame 109 via the second elastic member 123, and has a length protruded through an opening 109*a* of the movable frame 109.

The movable electrode 104 is provided at a bottom surface thereof with at least one pivot boss 131 and 133.

The pivot bosses 131 and 133 induce a planar contact when contacted with the contact member 111 along with the second elastic member 123, and constitute a pivot point during restoration of the movable electrode 104.

Although the pivot bosses 131 and 133 are formed on the bottom surface of the movable electrode 104 in the drawing, it should be apparent that they may also be formed on the substrate 101.

Figure 5A:
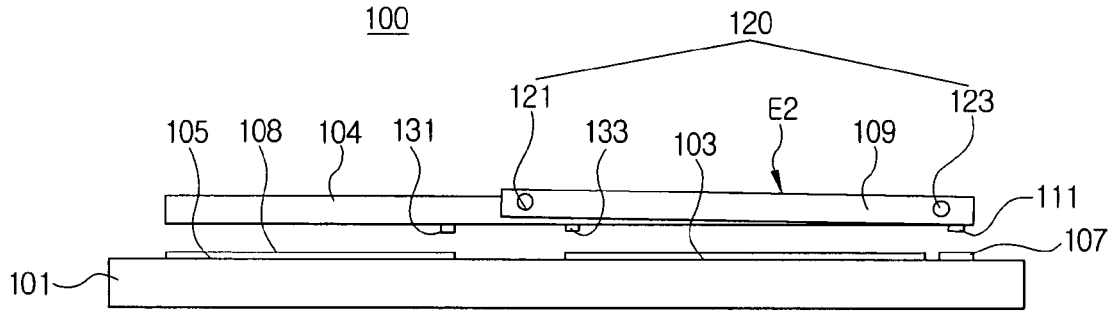
FIGS. 5A through 5D illustrate an operational state of MEMS switch of FIGS. 3 and 4.

FIGS. 5A through 5D illustrate an operational state of MEMS switch of FIGS. 3 and 4, where FIG. 5A illustrate a state where a voltage is applied to the fixed electrode 103 for contacting the contact member 111.

Figure 5B:
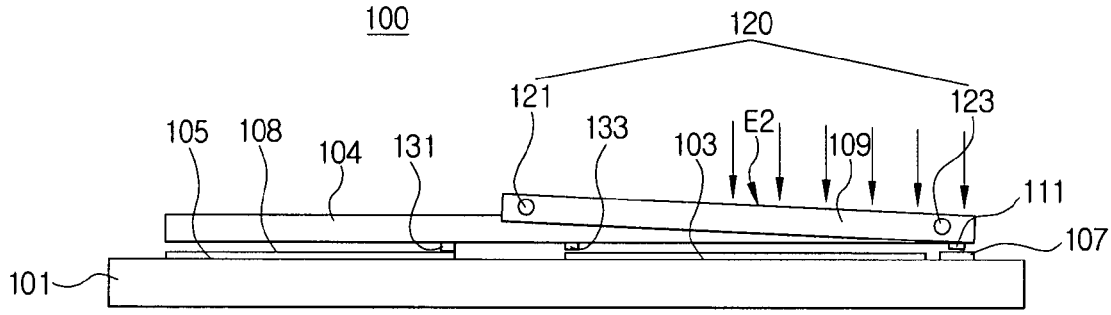

If a voltage is applied to the fixed electrode 103 as illustrated in FIG. 5B, the fixed electrode 103 and the movable electrode 104 are electrically charged, and the movable electrode 104 is pulled to the substrate 101 side by the electrostatic attraction.

As a result, the movable frame 109 is clockwise rotated about the first elastic member 121 to cause the contact member 111 to contact the signal line 107.

At this time, the movable electrode 104 conducts an additional rotational operation with regard to the movable frame 109 via the second elastic member 121 to cause the pivot bosses 131 and 133 to contact the substrate 101.

In the drawings, the pivot bosses 131 and 133 are shown to contact the top surface of the fixed electrode 103 and the restoring electrode 105.

Because the movable electrode 104 is additionally rotated about the second elastic member 123, the contact member 111 is contacted in the same fashion as that of the conventional planar type to thereby enable to improve the contact force of the contact member 111.

Figure 5C:
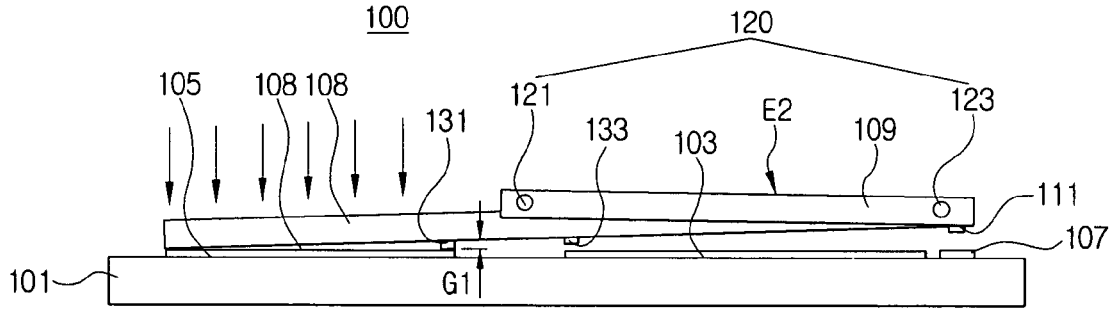

FIG. 5C illustrates a restored state of the movable electrode 104.

If the voltage of the fixed electrode 103 is blocked and a restoring voltage is applied to the restoring electrode 105, the movable electrode 104 is rotated counterclockwise about the pivot boss 131, and the movable frame 109 is distanced from the signal line 107.

As a result, the contact member 111 is detached from the signal line 107.

At this time, a restoring force can be further improved compared with that of the prior art because the height of the pivot boss 131 constitutes a bit of gap (G1) from the top surface of the substrate 101. Therefore, there is an advantage in that a restoring voltage consumption rate for restoring the movable electrode 704 is reduced.

Figure 5D:
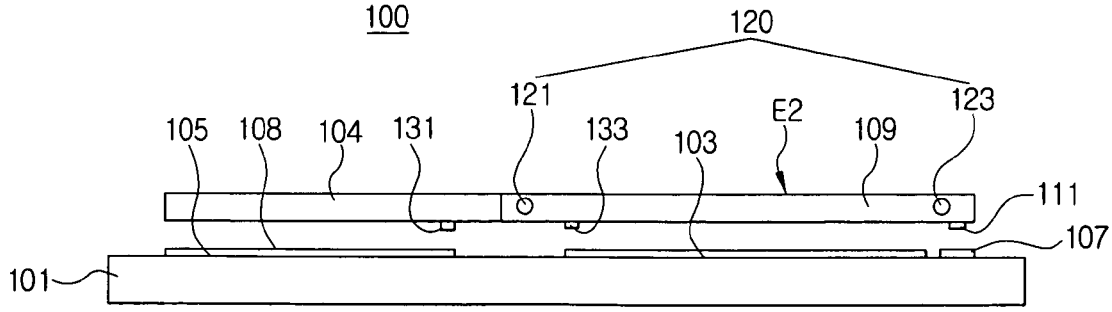

Then, the restoring voltage is released as shown in FIG. 5D, the movable electrode 104 returns to an initial switch state.

At this time, during the operation of the switch, once the pivot boss is supported to the substrate by an initial pull-in voltage, the switch can be repeatedly operated in between a contact state of the switch as shown in FIG. 5B and a restored state of a non-contacted switch as illustrated in FIG. 5C for improvement of the switching speed.

This is because an immediate response of the pivot boss occurs toward an axis without the need of response by a mechanical spring when the switch is turned on and off by the electrostatic force.

As a result, if the restoring voltage is released and the switch is returned to an initial state, a state where the switch is no longer operated is preferred.

Although the above description has illustrated the contact member 111 formed on the bottom surface of the movable frame 109, it should be also apparent that the contact member 111 is formed on the bottom surface of the movable electrode 104.

Figure 6:
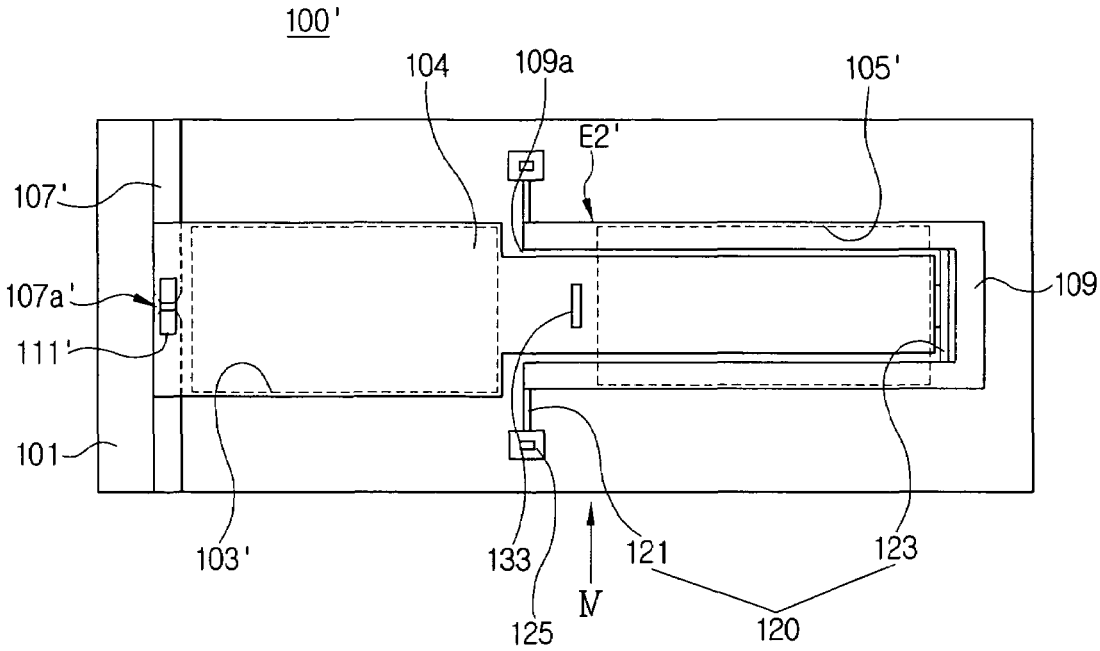
FIG. 6 and FIG. 7 illustrate another example of a MEMS switch where a formed location of a contact member is changed.
Figure 7:
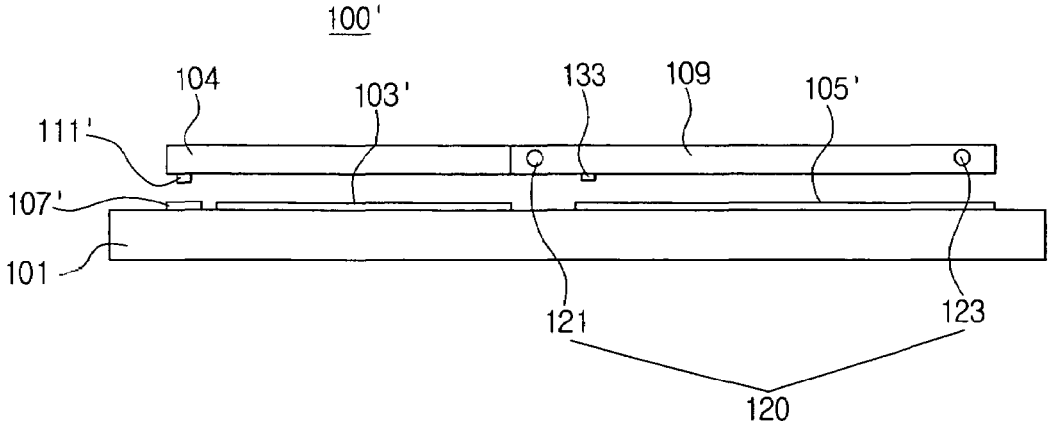

FIG. 6 and FIG. 7 illustrate another example of a MEMS switch where a formed location of a contact member 111' is changed to be located on a bottom surface of the movable electrode 104.

The only difference from description of FIGS. 3 and 4 is that a signal line 107' is formed at the other end of the movable electrode 104 where the second elastic member 121 is mounted.

At this time, a fixed electrode 103' and a restoring electrode 105' are oppositely located from what is on FIGS. 3 and 4.

FIGS. 8A through 8D are schematic representations illustrating an operational principle of a switch illustrated in FIGS. 6 and 7, the principle of which is the same as that of FIGS. 5A through 5D.

Figure 8A:
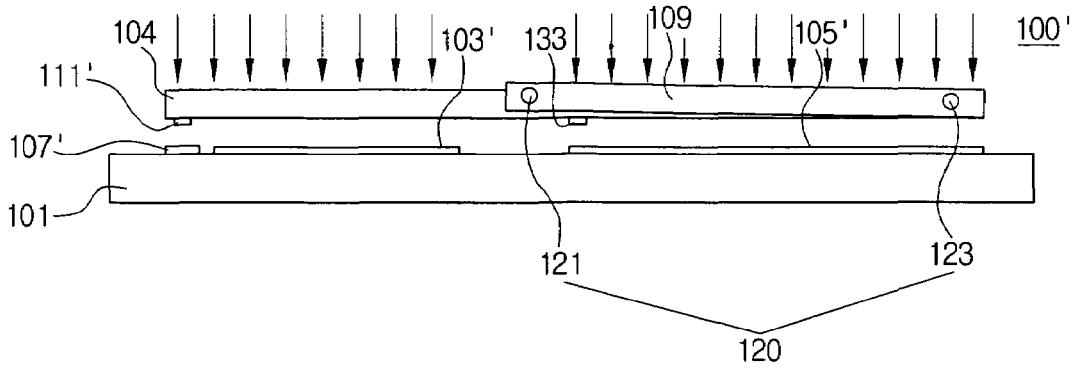
FIGS. 8A through 8D are schematic representations illustrating an operational principle of a switch illustrated in FIGS. 6 and 7.

The only difference is that, as shown in FIG. 8A, a voltage is simultaneously applied to the restoring electrode 105' side during initial operation in order to reduce an initial pull-in voltage of the contact member 111'.

By applying voltage to the restoring electrode 105' and the fixed electrode 103' at the same time, the movable electrode 104 can receive a far greater force toward the substrate 101.

Figure 8B:
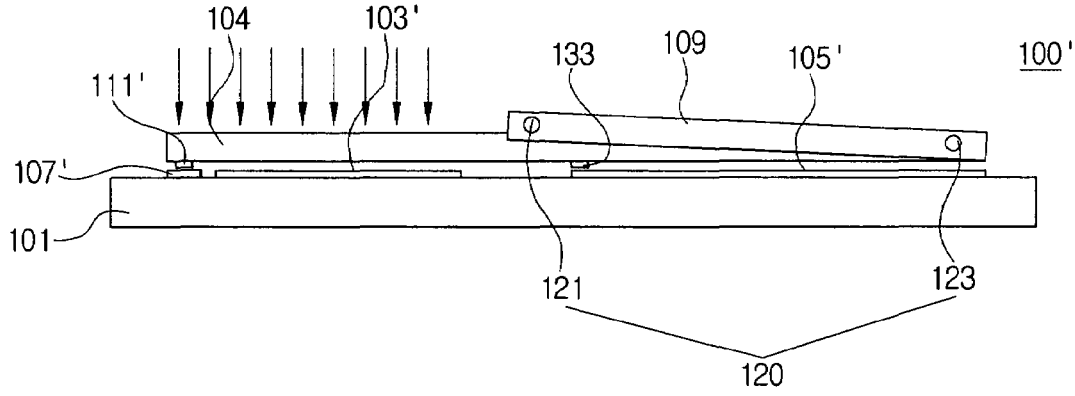
Figure 8C:
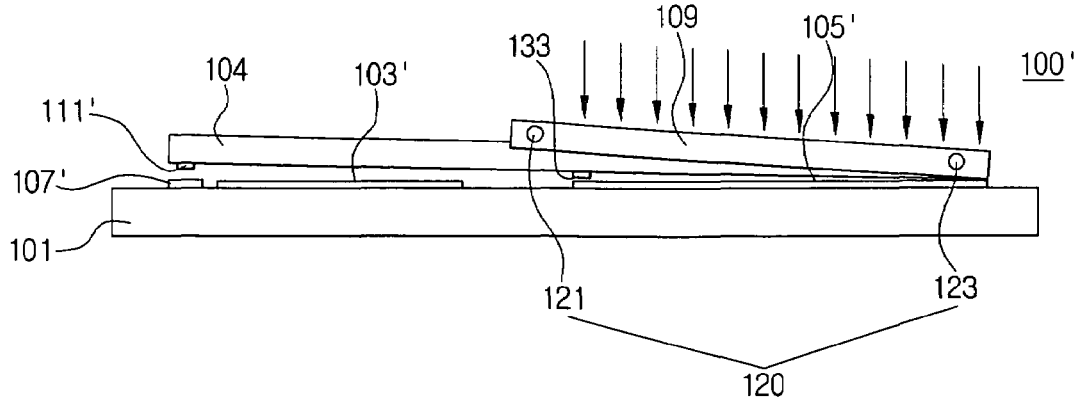
Figure 8D:
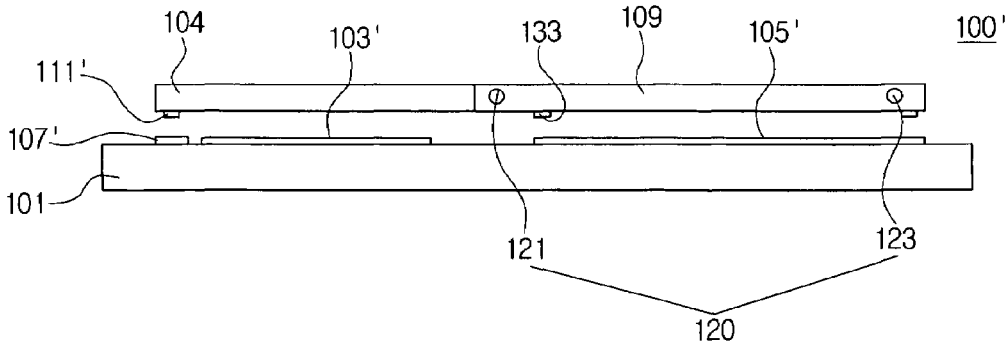

Thereafter, as illustrated in FIG. 8B, if the restoring electrode 105' is relieved of its voltage, the contact member 111' can contact the contact part 107*a*' of the signal line 107'.

In FIGS. 6 through 8D, same reference numerals are given as in those of FIGS. 3 through 5D, such that no detailed description will be omitted.

Next, description of a structure where a plurality of switches are employed, for example, an SP3T (Single Pole Three Through) switch, will be made with reference to the attached drawings.

Figure 9:
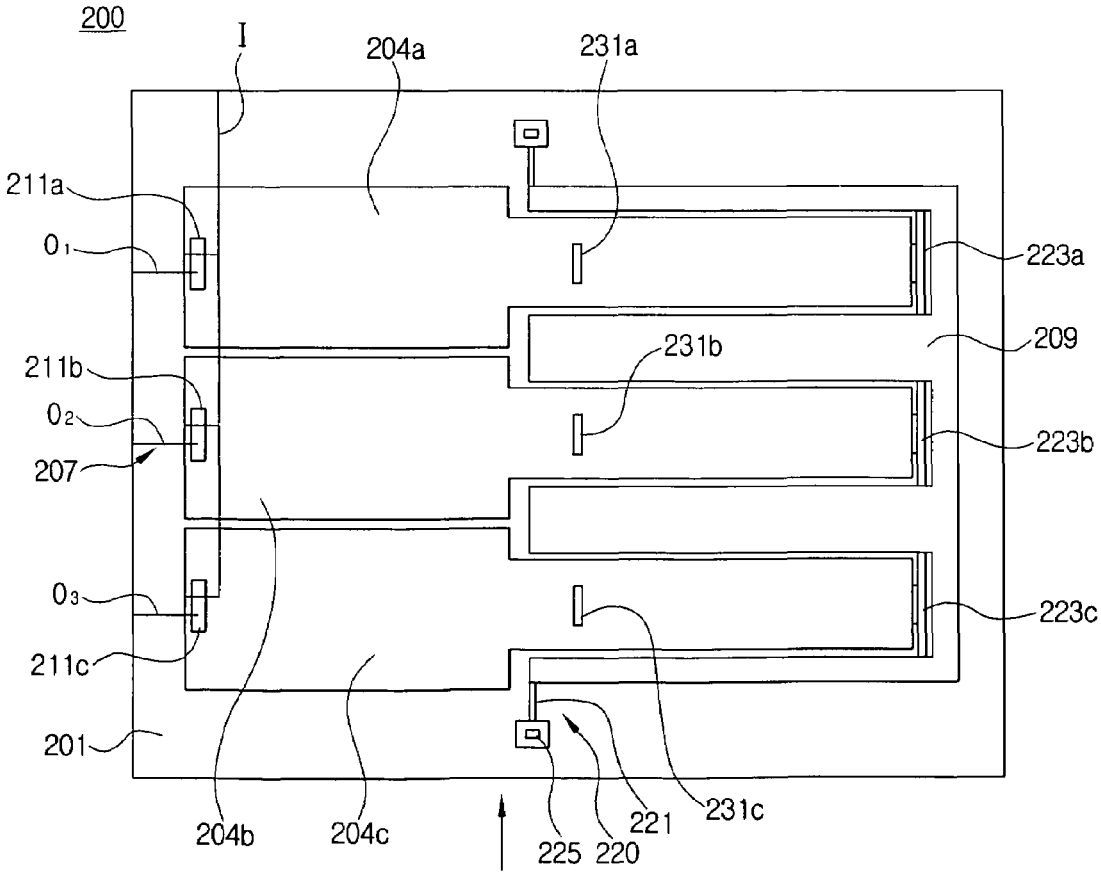
FIG. 9 is a schematic representation illustrating a SP3T (Single Pole Three Through) switch where structure of FIG. 7 is applied.
Figure 10:
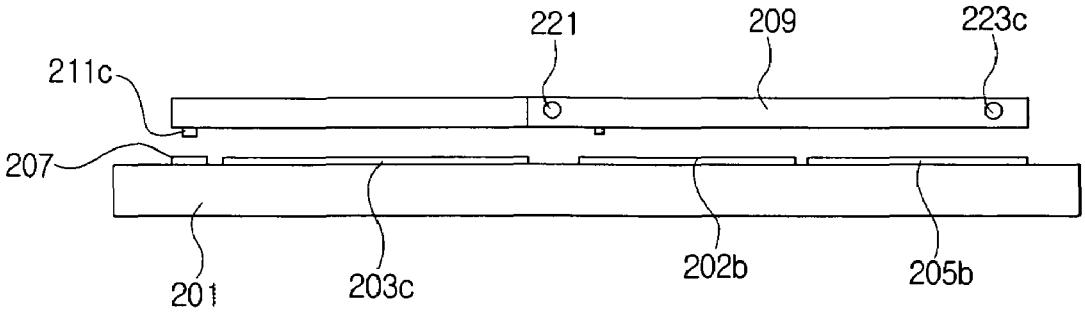
FIG. 10 is a lateral view taken along an arrow V of FIG. 9.

FIG. 9 is a schematic representation illustrating an SP3T (Single Pole Three Through) switch 200 where a structure of FIG. 7 is applied, and FIG. 10 is a lateral view taken along an arrow V of FIG. 9.

Referring to FIGS. 9 and 10, movable electrodes 204*a*, 204*b* and 204*c*, each having the same construction as the movable electrode 104 of FIG. 7, are aligned in parallel on a substrate 201 each spaced a predetermined distance apart, against which, a movable frame 209 is arranged.

At this time, three movable frames 209 are integrally formed.

Signal lines 207 are formed in such a manner that a signal inputted through a single input line (I) can be divided into three output lines $O_1$, $O_2$ and $O_3$.

One end of the bottom surface of each movable electrode 204*a*, 204*b* and 204*c* is respectively arranged with contact members 211*a*, 211*b* and 211*c*, and a central area of the bottom surfaces of the movable electrodes 204*a*, 204*b* and 204*c* are respectively formed with pivot bosses 231*a*, 231*b* and 231*c*.

Referring to FIG. 9, an elastic support unit 220 includes a first elastic member 221 protrusively formed on both sides of an end of the movable frame 209 and second elastic members 223*a*, 223*b* and 223*c*, where the first elastic member 221 is supported by an anchor 225.

Figure 11:
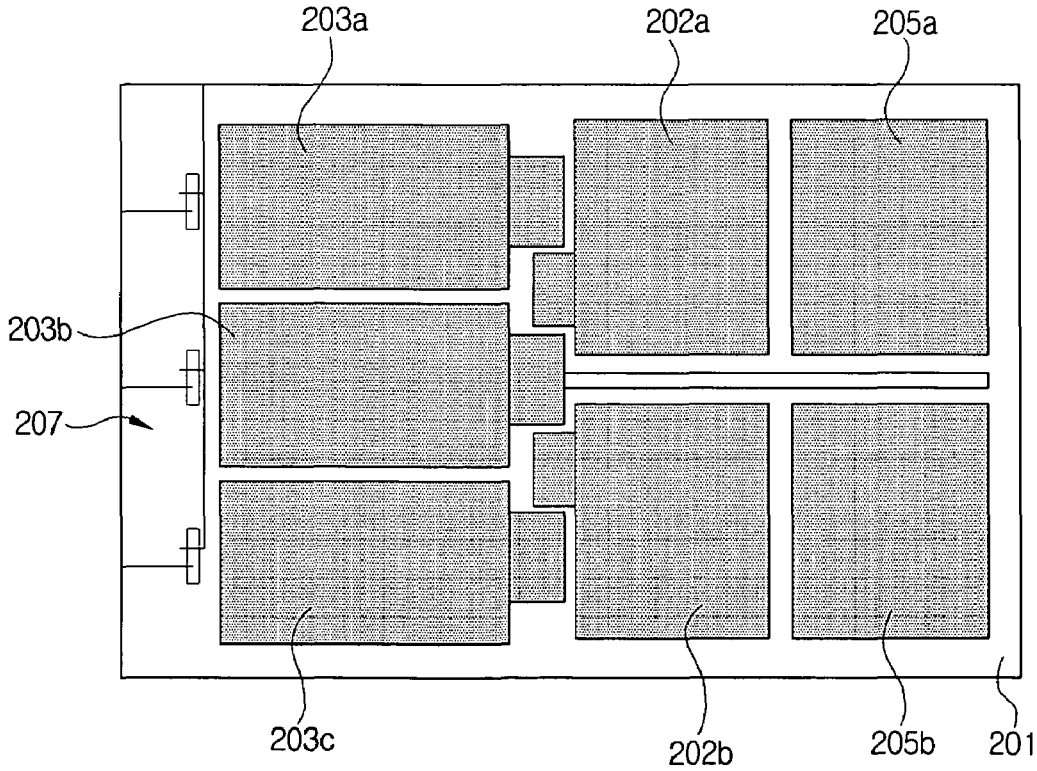
FIG. 11 is a plan view illustrating a structure of fixed electrodes formed on a substrate of FIG. 9.

FIG. 11 is a plan view illustrating a structure of fixed electrodes of an SP3T switch.

Referring to FIG. 11, the SP3T switch is comprised of common fixed electrodes 202*a* and 202*b* for driving the movable frame 209, fixed electrodes 203*a*, 203*b* and 203*c* corresponding to a plurality of movable electrodes 204*a*, 204*b* and 204*c* (See FIG. 9) for generating an actual contact force, and common restoring fixed electrodes 205*a* and 205*b* for restoring the movable electrodes 204*a*, 204*b* and 204*c*.

Next, an operational principle of the above mentioned SP3T switch will be briefly described.

FIGS. 12A through 12D illustrate an operational state showing a procedure of how a SP3T switch according to an exemplary embodiment of the present invention is operated, and FIGS. 13A through 13D illustrate an applied state of driving voltage of fixed electrodes for driving a switch to a state of FIGS. 12A through 12D. Areas of FIGS. 13A through 13D indicated in darkness show where driving voltage is applied.

Figure 12A:
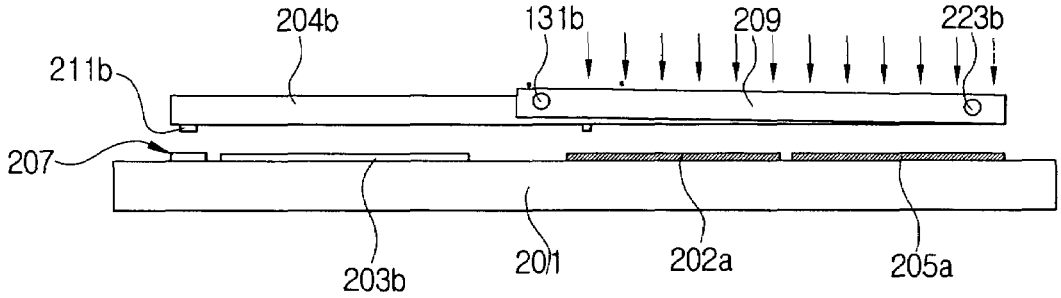
FIGS. 12A through 12D illustrate an operational state showing a procedure of how an SP3T switch according to an exemplary embodiment of the present invention is operated.
Figure 13A:
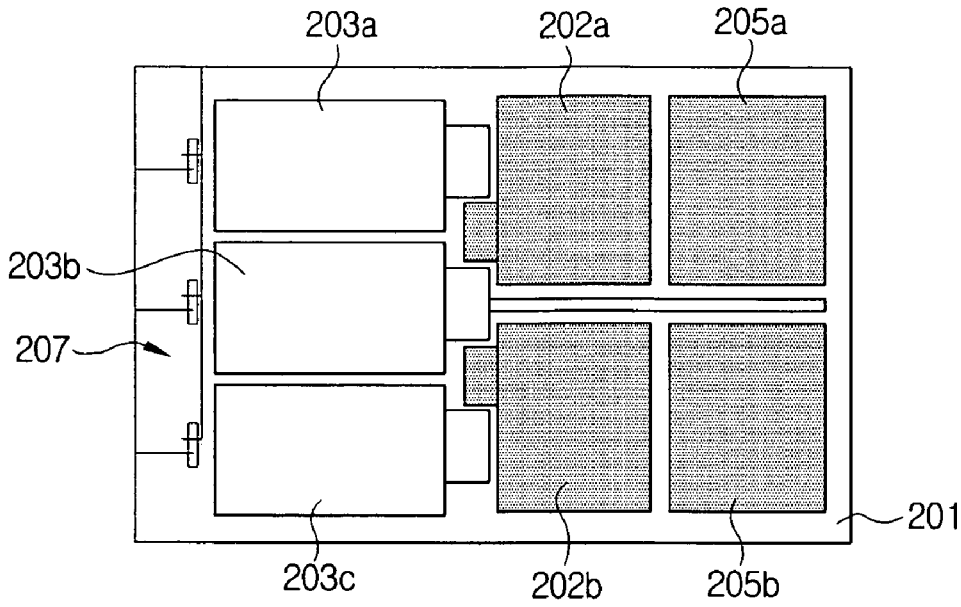
FIGS. 13A through 13D illustrate an applied state of driving voltage of fixed electrodes for driving a switch to a state of FIGS. 12A through 12D.

Referring to FIGS. 12A and 13A, a voltage is applied to common fixed electrodes 202*a* and 202*b* and common restoring electrodes 205*a* and 205*b*.

The reason the voltage is simultaneously applied to the common fixed electrodes 202*a* and 202*b* and the common restoring electrodes 205*a* and 205*b* is to reduce an initial pull-in voltage and to improve a switching speed, as previously described with respect to FIG. 8A.

Figure 12B:
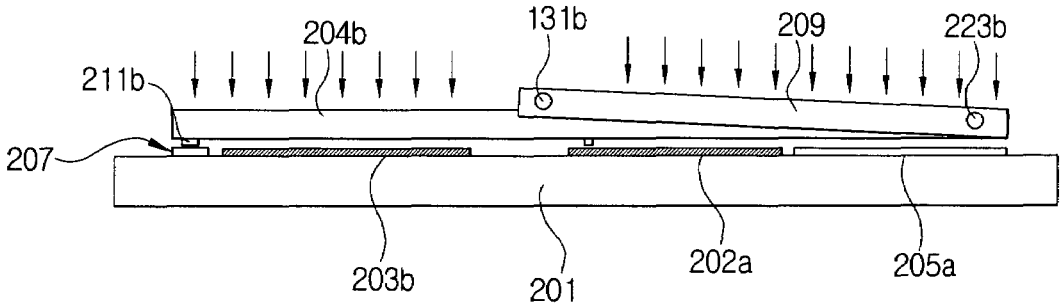
Figure 13B:
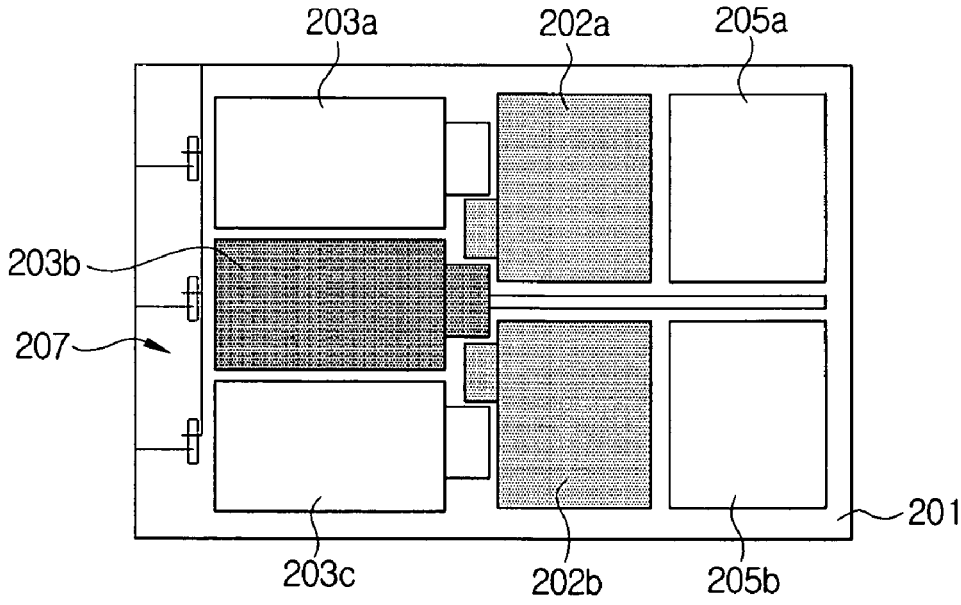

Successively, referring to FIGS. 12B and 13B, if the voltage of the common restoring electrodes 205*a* and 205*b* are released and a predetermined voltage is applied to the centrally-located fixed electrode 203*b*, the movable electrode 204*b* opposite to the fixed electrode 203*b* is further lowered to allow the contact member 211*b* to be connected to an input line (I) and an output line ($O_2$).

Figure 12C:
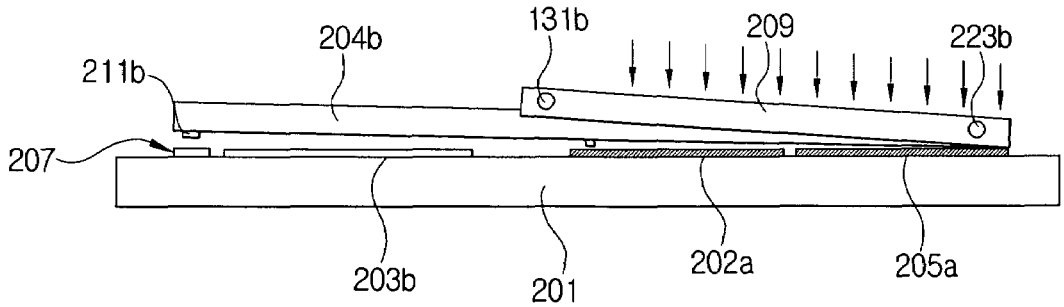
Figure 13C:
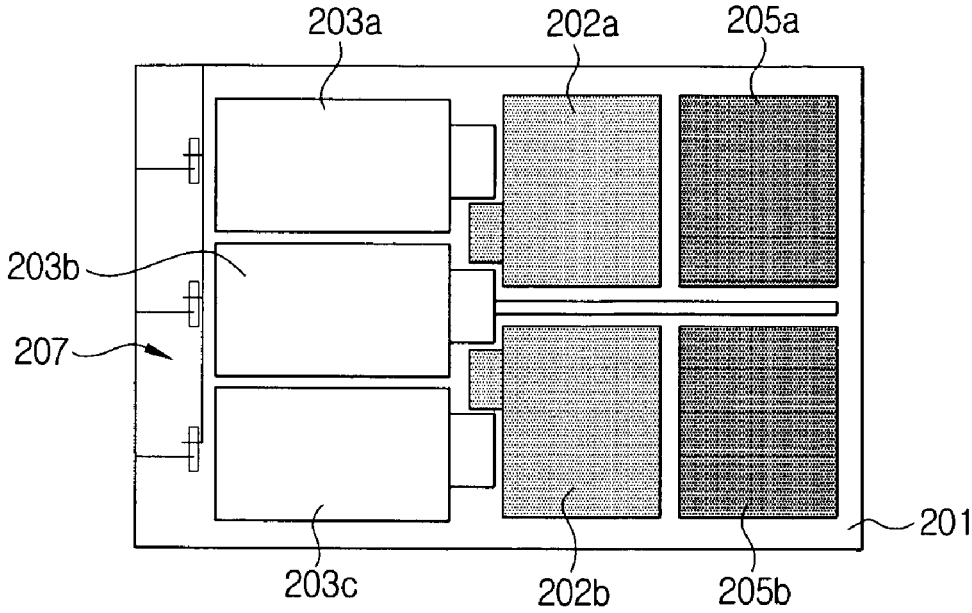

Now, referring to FIGS. 12C and 13C, if voltage is simultaneously applied to the common fixed electrodes 202*a* and 202*b* and common restoring electrodes 205*a* and 205*b* in order to restore the movable electrode 204*b*, the movable electrode 204*b* is rotated clockwise about the pivot boss 131*b* whereby the contact member 211*b* is distanced from the input line (I) and the output line ($O_2$).

Figure 12D:
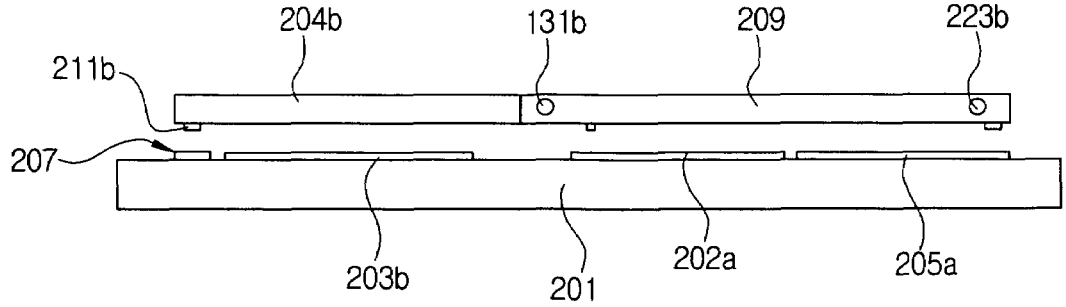
Figure 13D:
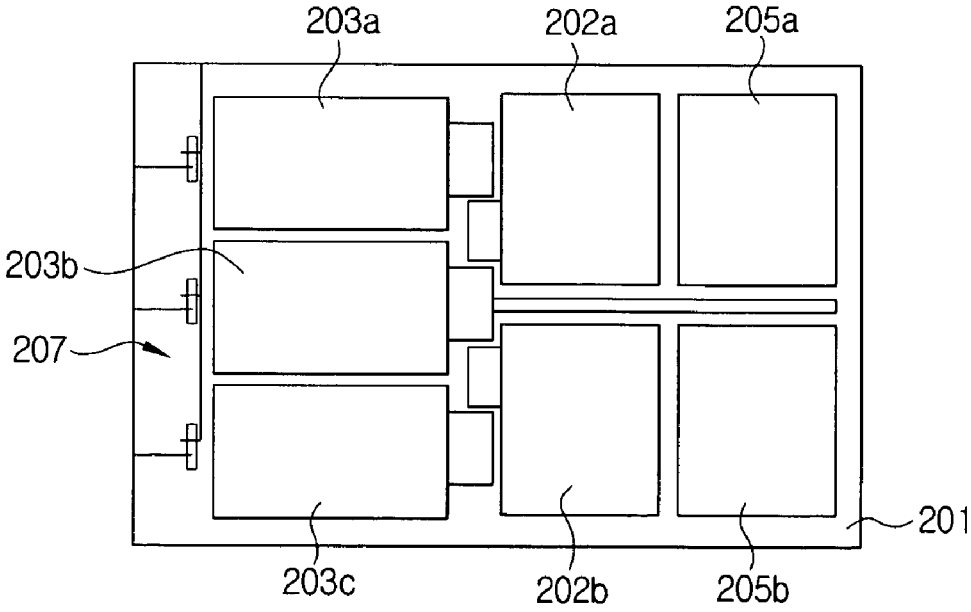

Referring to FIGS. 12D and 13D, if voltage is completely released from all the fixed electrodes, the switch is restored to an initial state.

The switching operation of the movable electrode 204*b* has been explained as an example; however, the moveable electrodes 204*a*, 204*c* are also operated by the same principle as that of the movable electrode 204*b*.

Second Embodiment

Next, another exemplary embodiment will be described where the first and second elastic members are made to be further weakened in strength thereof, an initial pull-in voltage is reduced and a switching speed is improved by switch turn-on and turn-off driving by pivot boss, thereby enabling in the creation of a bulk structure.

Figure 14:
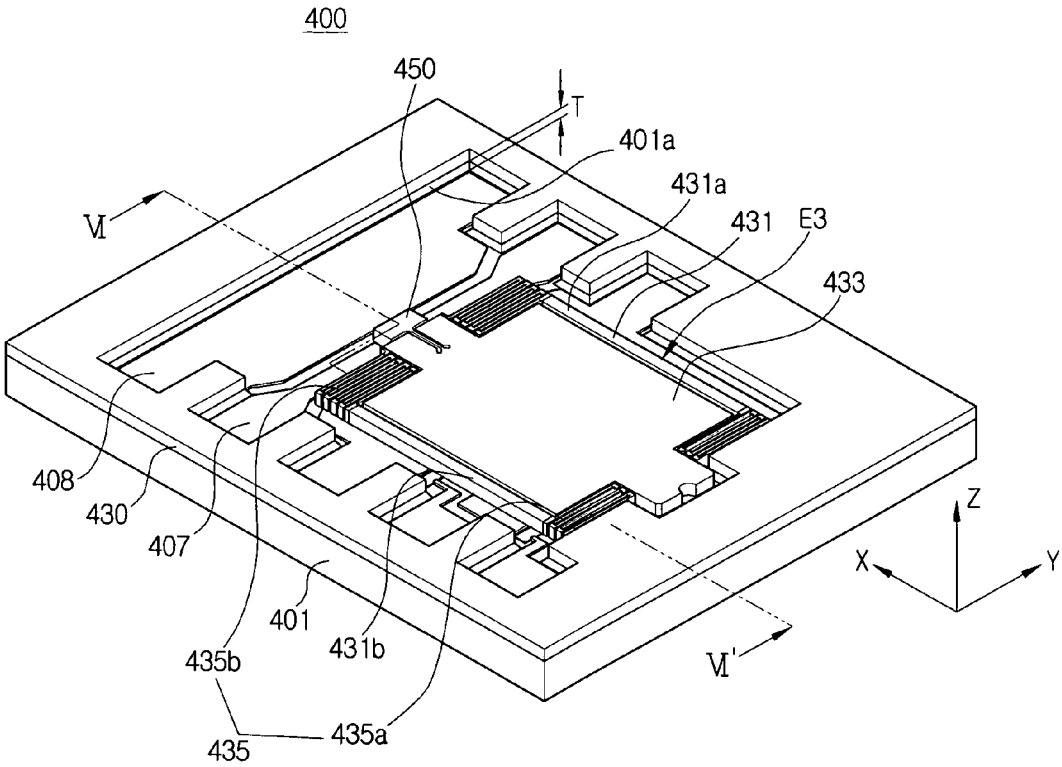
FIG. 14 is a perspective view illustrating a structure of a MEMS switch according to another exemplary embodiment of the present invention.
Figure 15:
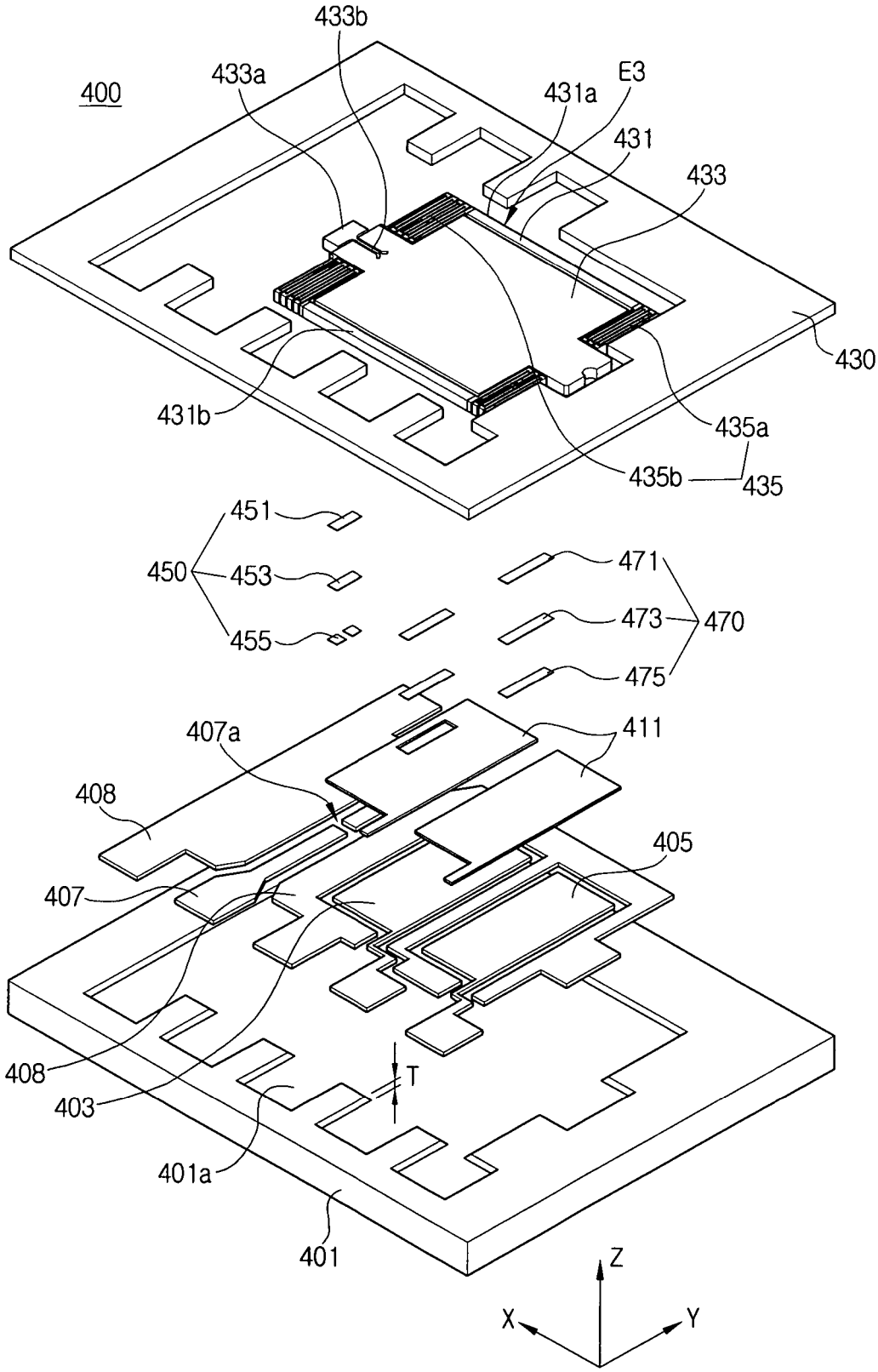
FIG. 15 is a broken perspective view illustrating a structure of FIG. 14.

FIG. 14 is a perspective view illustrating a structure of a MEMS switch according to another exemplary embodiment of the present invention, and FIG. 15 is a broken perspective view illustrating a structure of FIG. 14.

Referring to FIGS. 14 and 15, a lower substrate 401 made of an insulating material, for example, glass is provided on which a predetermined depth (T) is formed around which a bottom electrode groove 401*a* is arranged.

A fixed electrode 403, a restoring electrode 405 and a signal line 407 are vapor-deposited on a top of the bottom electrode groove 401*a* in that order. These electrodes are made of conductive material, for example, Au.

The reason for forming the bottom electrode groove 401*a* is to provide a space for a movable frame 431 and a movable electrode 433 (both to be described later) to horizontally and vertically fluctuate therein.

The fixed electrode 403 and the restoring electrode 405 may be additionally formed thereon with an insulation layer 411, for example, SiN or $SiO_2$ films.

Next, the lower substrate 401 is bonded by a top substrate 430 integrally formed with a movable frame 431 made of elastic connector (E3), an elastic support unit 435 and a movable electrode 433 in that order.

The top substrate 430 may be made of conductive material, for example, Si.

Now, a detailed description is made about the top substrate 430.

The top substrate 430 is formed at an inner side thereof with a first elastic member 435*a* comprising the elastic support unit 435.

The other end of the first elastic member 435*a* is connected to a pair of movable beams 431*a* and 431*b* comprising the movable frame 431 each spaced a predetermined distance apart.

At a distal end of the movable beams 431*a* and 431*b* is extensively disposed a second elastic member 435*b*, and a distal end of the second elastic member 435*b* is connected to one end of the movable electrode 433.

The movable electrode 433 is interposed between the movable beams 431*a* and 431*b* and is relatively rotated about the second elastic member 435*b* relative to the movable beams 431*a* and 431*b* while the pair of movable beams 431*a* and 431*b* are rotated via the first elastic member 435*a*.

The first and second elastic members 435*a* and 435*b* may be formed in such a manner that a spring strength is designed to be weak to thereby reduce initially required pull-in voltage, and influence by a mechanical spring is minimized when the spring is operated while the pivot boss is brought into contact with the substrate.

Therefore, the first and second elastic members 435*a* and 435*b* may be, for example, serpentine in shape.

Figure 16:
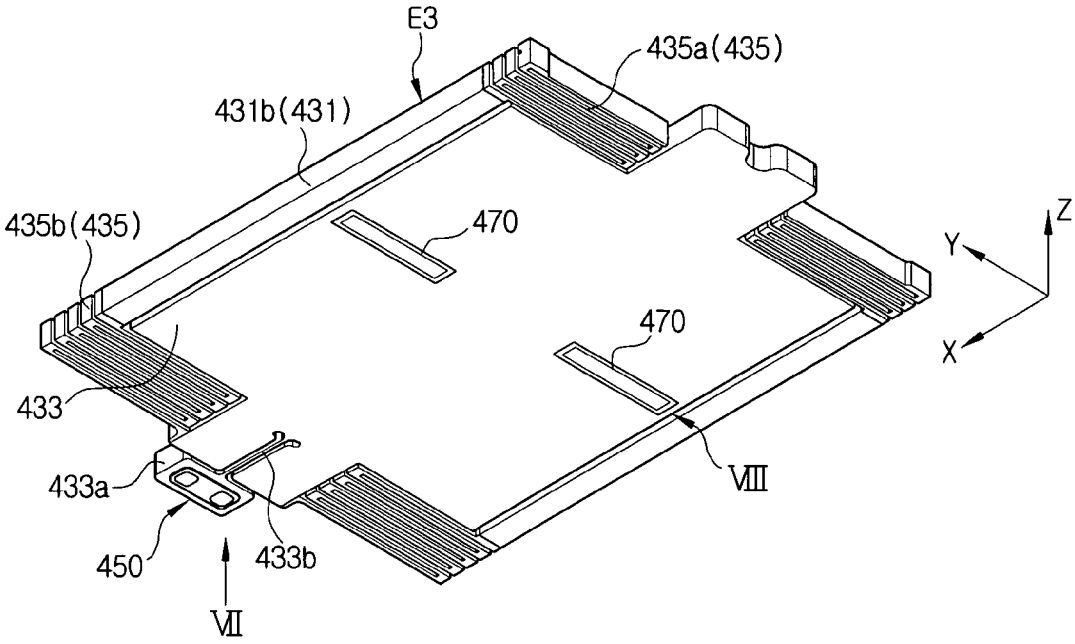
FIG. 16 is a perspective view illustrating a rear surface of a movable electrode part of FIG. 14.
Figure 17:
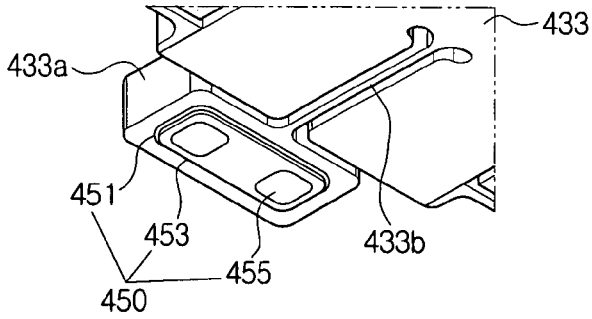
FIG. 17 is an enlarged view of a VII display part of FIG. 16.
Figure 18:
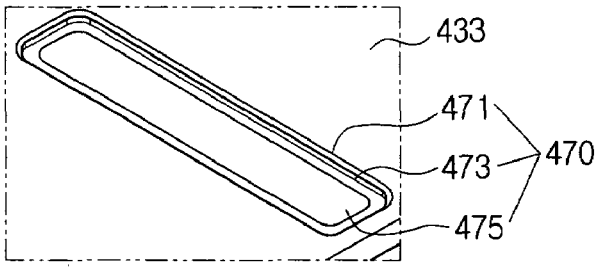
FIG. 18 is an enlarged view of VIII display part of FIG. 16.

FIG. 16 is a perspective view illustrating a rear surface of a movable electrode part of FIG. 14, FIG. 17 is an enlarged view of a VII display part of FIG. 16, and FIG. 18 is an enlarged view of VIII display part of FIG. 16.

Referring to FIGS. 16 and 17, a contact member 450 is formed at a distal end of a bottom surface of the movable electrode 433.

The contact member 450 contacting a contact part 407*a* of signal line 407 (See FIG. 15) is comprised of a contact insulation layer 451 for insulation from the movable electrode 433, a contact conductive layer 453 contacting the signal line 407 and a contact boss 455.

The contact insulation layer 451 may be formed with, for example, SiN or $SiO_2$ layer, and the contact conductive layer 453 and the contact boss 455 are formed with, for example, Au.

A distal end of the movable electrode 433 formed with the contact member 450 is formed with a contact part 433*a* formed in the shape corresponding to that of the contact member 450, and the contact part 433*a* is rockingly connected to a distal end of the movable electrode 433 via a spring arm 433*b* located in the crossing direction with the signal line 407.

The reason of making the contact part 433*a* rocking is to solve the problem of the movable electrode 433 not being able to maintain an accurate horizontal state to disable the contact member 450 from contacting the signal line 407 accurately.

In other words, even if the contact member 450 is lopsidedly located, it can rotate about the spring arm 433*b* to induce the contact member 450 to stably contact an upper surface of the signal line 407.

Now, referring to FIGS. 16 and 18, the movable electrode 433 is formed with a pivot boss 470 at an approximate center thereof.

The pivot boss 470 may be patterned on the same layer as that of formation of the contact member 450, and in this case, the pivot boss 470 takes the same structure as that of contact member 450 which is the insulation layer 471/two-tier conductive layers 473 and 475.

The pivot boss 470 may be singularly formed, although in the drawing, the pivot bosses are paired on an approximate center of the movable electrode 433.

Figure 19:
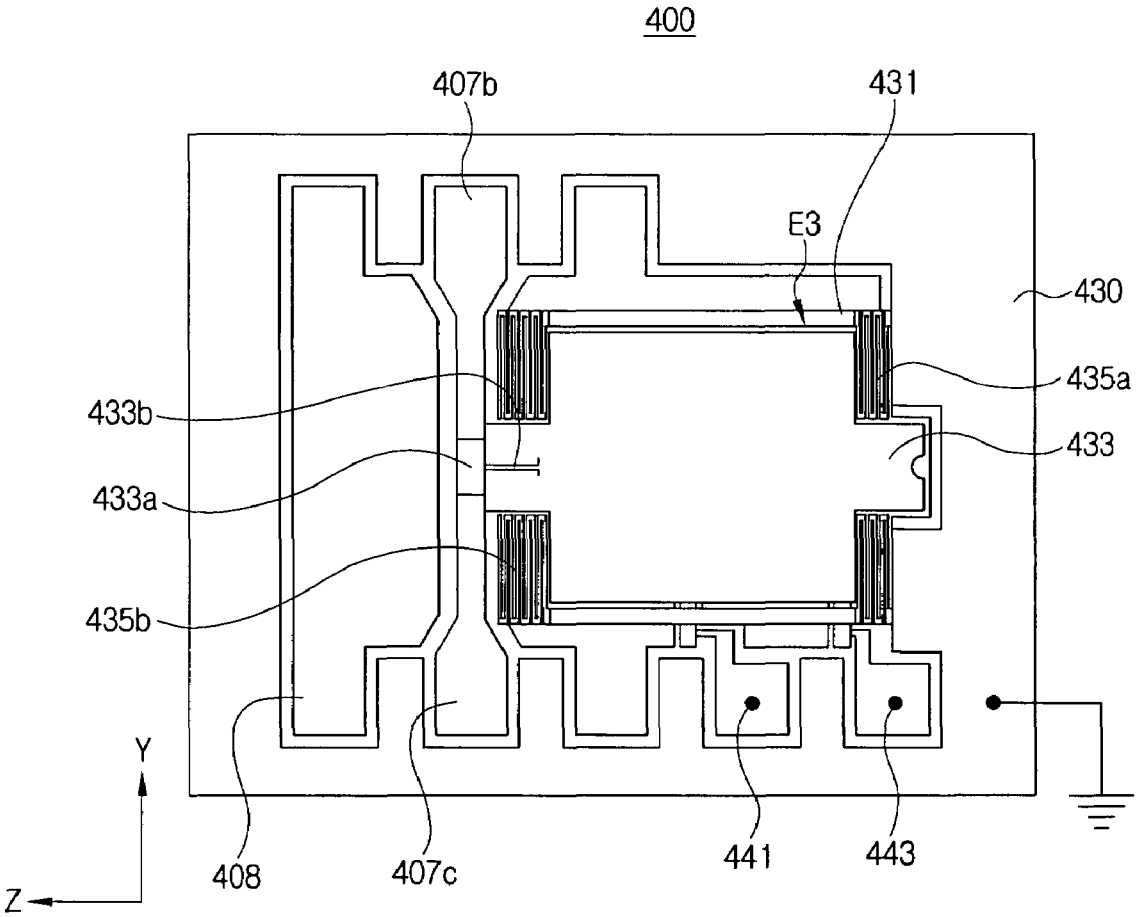
FIG. 19 is a schematic representation illustrating an electrically connected relation of a MEMS switch of FIG. 16.

FIG. 19 is a schematic representation illustrating an electrically connected relation of a MEMS switch according to another exemplary embodiment of the present invention.

Referring to FIG. 19, the signal line 407 is comprised of an input line 407*b* into which a signal is inputted and an output line 407*c* from which the signal is outputted. The signal line 407 is provided at both sides thereof with grounds 408.

Reference numeral 441 denotes a driving voltage applying part for applying the voltage to the fixed electrode 403, and reference numeral 443 denotes a restoring voltage applying part for applying a restoring voltage to the restoring electrode 405.

The top substrate 430 is grounded for operation of the movable electrode 433.

Next, operation procedure of the MEMS switch according to another exemplary embodiment of the present invention will be schematically described.

Figure 20A:
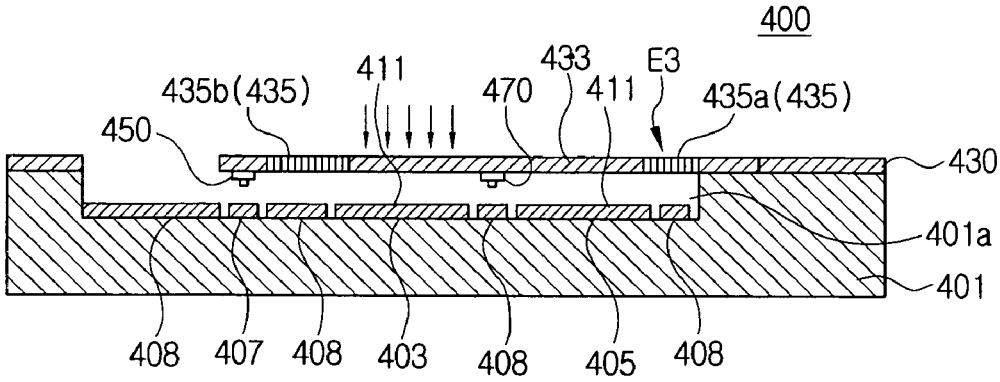
FIG. 20A is a cross-sectional view taken along line VI-VI' of FIG. 14.
Figure 20B:
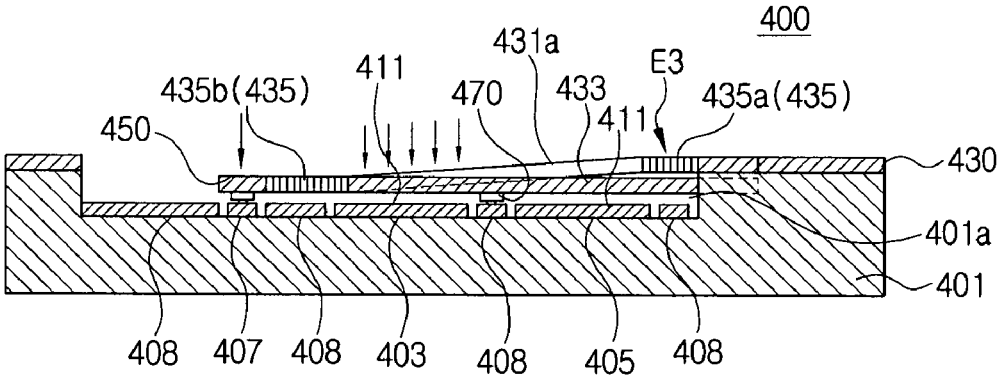
FIG. 20B is a cross-sectional view illustrating a state where a contact member of FIG. 20A is contacted.
Figure 20C:
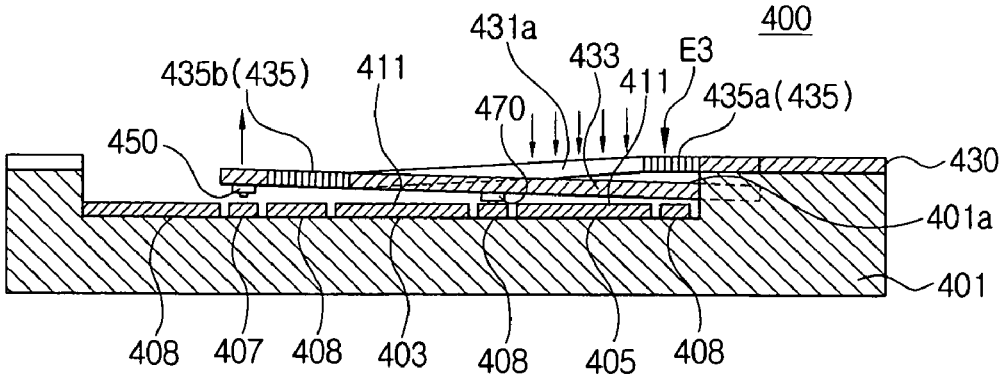
FIG. 20C is a cross-sectional view illustrating a state where a movable electrode of FIG. 20A is restored.

FIG. 20A is a cross-sectional view taken along line VI-VI' of FIG. 14, FIG. 20B is a cross-sectional view illustrating a state where a contact member of FIG. 20A is contacted, and FIG. 20C is a cross-sectional view illustrating a state where a movable electrode of FIG. 20A is restored.

The basic operational principle is the same as that of what is shown in FIGS. 5A through 5C and 8A through 8C, except that strength of the first and second elastic members 435*a* and 435*b* is so designed as to be weaker than that of first and second elastic members 121 and 123 to thereby enable to facilitate the switch operation using the pivot boss and at the same time to reduce initially required pull-in voltage.

Now, a manufacturing method of a MEMS switch thus described will be described.

Figure 21A:
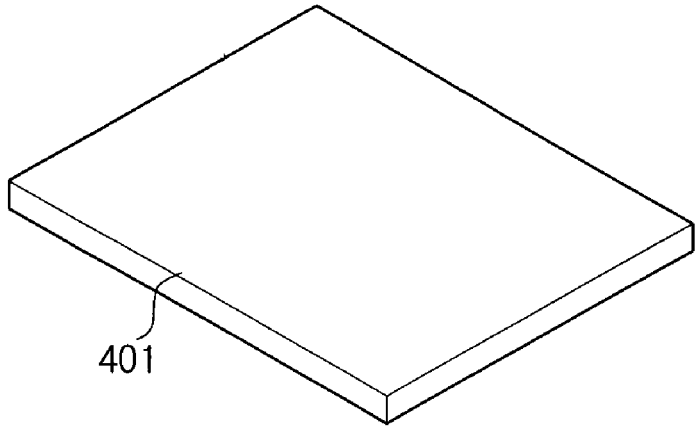
FIGS. 21A through 21D illustrate a manufacturing process of a lower substrate applied to a MEMS switch according to still another exemplary embodiment of the present invention.
Figure 21B:
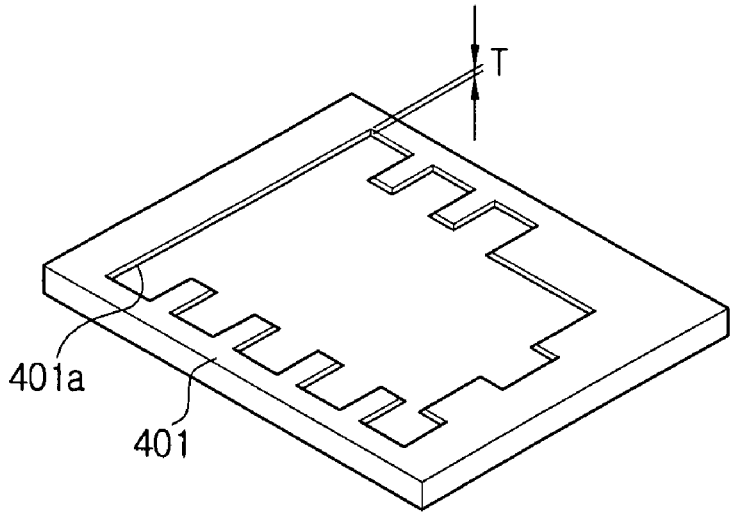
Figure 21C:
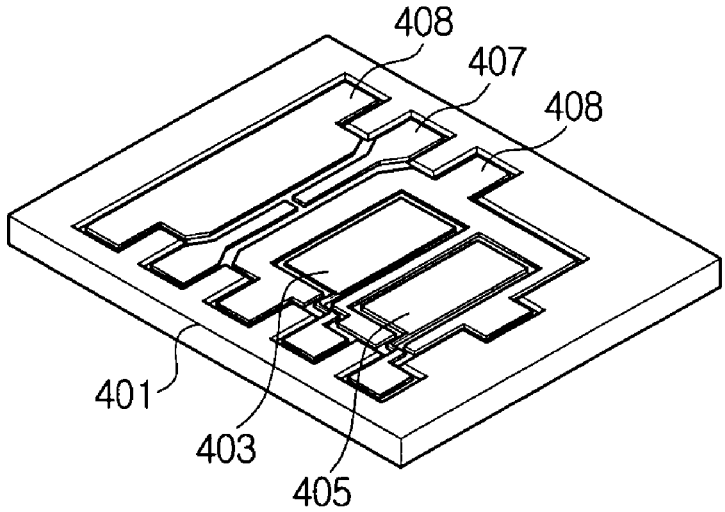
Figure 21D:
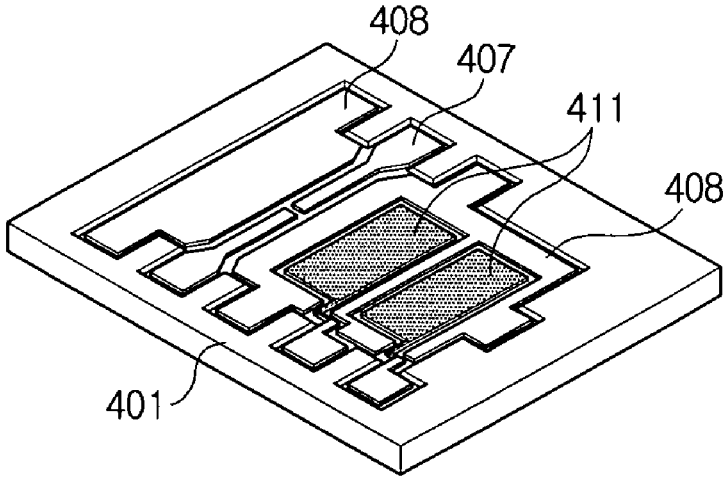
Figure 22A:
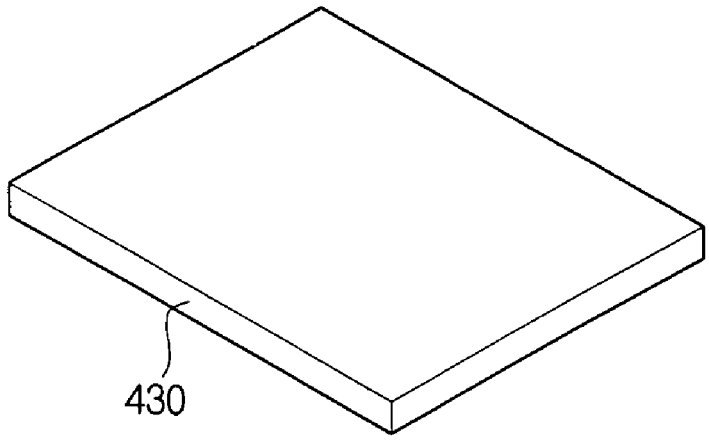
FIGS. 22A through 22D illustrate a manufacturing process of a top substrate applied to a MEMS switch according to still further exemplary embodiment of the present invention.
Figure 22B:
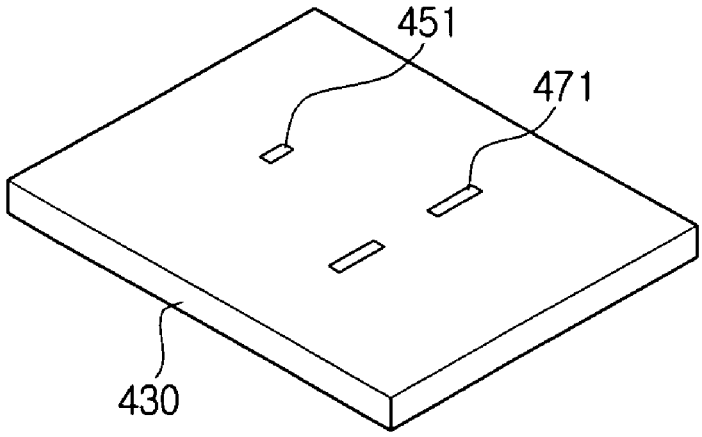
Figure 22C:
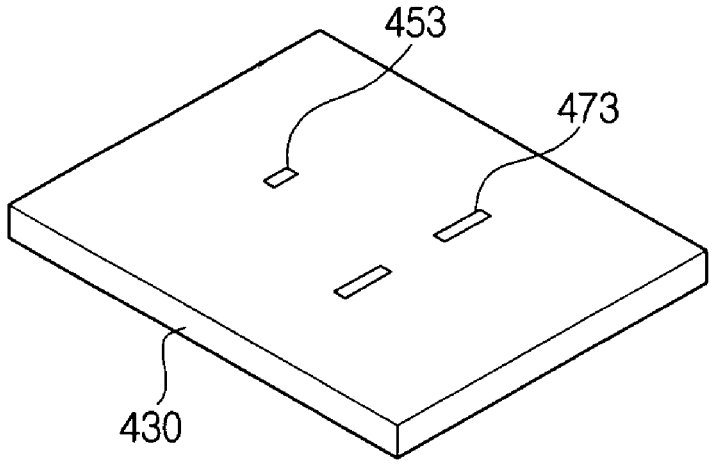
Figure 22D:
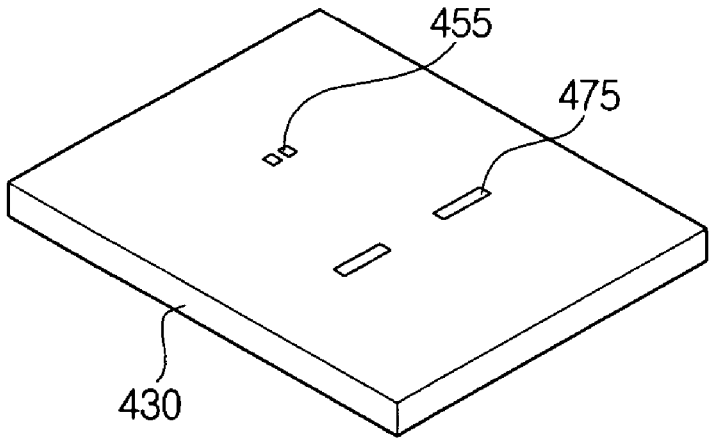
Figure 23A:
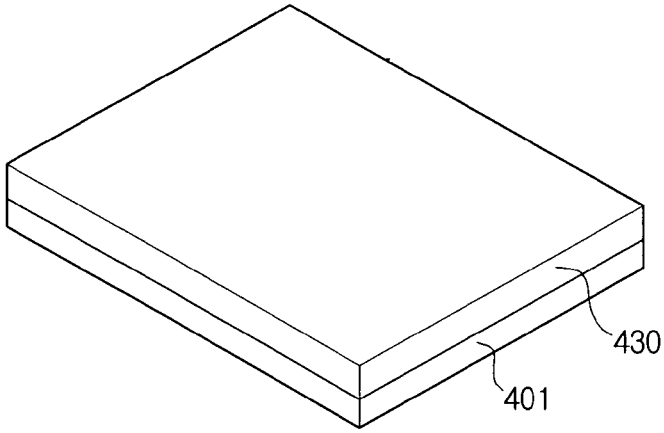
FIGS. 23A through 23C illustrate a process of finishing a MEMS switch by bonding the top and lower substrates.
Figure 23B:
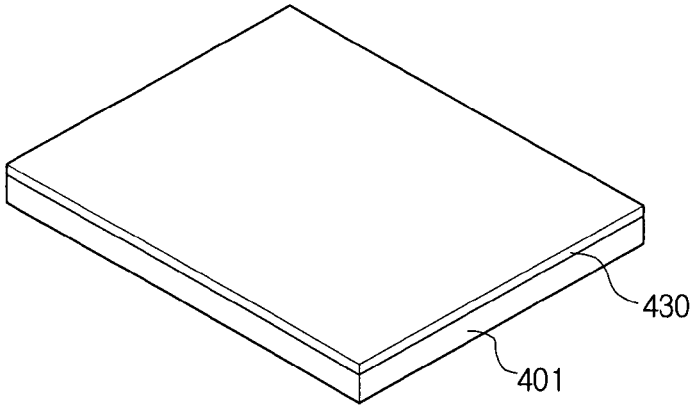
Figure 23C:
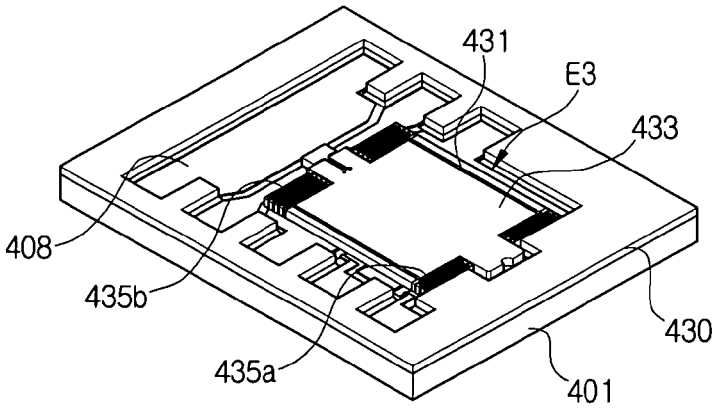

FIGS. 21A through 21D illustrate a manufacturing process of a lower substrate applied to a MEMS switch according to still another exemplary embodiment of the present invention, FIGS. 22A through 22D illustrate a manufacturing process of a top substrate applied to a MEMS switch according to still further exemplary embodiment of the present invention, and FIGS. 23A through 23C illustrate a process of finishing a MEMS switch by bonding the top and lower substrates.

Referring to FIG. 21A, a lower substrate made of insulating material, for example, glass, is provided.

Now, referring to FIG. 21B, a bottom electrode groove 401*a* where a bottom electrode is to be formed is formed at a top surface of the lower substrate 401 at a predetermined depth (T).

Referring to FIG. 21C, the bottom electrode groove 401*a* is formed thereon with a fixed electrode 403, a restoring electrode 405, a signal line 407 and a ground 408. Each electrode is formed with conductive material, for example, Au.

Referring to FIG. 21D, the fixed electrode 403 and the restoring electrode 405 are additionally formed thereon with an insulation layer 411, for example, SiN film or $SiO_2$.

The reason of forming the insulation layer 411 is for insulation from the movable electrode 433.

Next, a process of forming a contact member 540 and a pivot boss 470 on the top substrate 430 is executed.

Referring to FIG. 22A, a top substrate 430 made of conductive material, for example, silicon, is provided.

Referring to FIG. 22B, insulating material, for example, SiN film or $SiO_2$ film is vapor-deposited, and the contact member insulation layer 451 and a pivot insulation layer 471 are patterned.

The reason of forming the insulation layer 451 is to insulate a contact conductive layer 453 and a movable electrode 433 (to be formed at the next step).

Referring to FIG. 22C, a conductive material, for example, Au, is vapor-deposited and a contact conductive layer 453 and the pivot conductive layer 473 are formed.

Referring to FIG. 22D, the contact conductive layer 453 and pivot conductive layer 473 are again vapor-deposited thereon with a conductive layer, on which a contact boss 455 and a pivot boss 475 are formed.

Although in the above process, the pivot boss 470 and the contact member 450 are formed on the same tier, this is to simplify the manufacturing process, and there is no absolute need to form the contact member 450 and the pivot boss 470 on the same tier.

Although description has been made with the contact boss 455 being formed in a pair, there is no absolute need for the contact boss 455 to be formed in a pair. It is possible that the conductive layer is in the first tier, and a contact part of the contact member 450 is formed.

Now, a manufacturing process of constituting a movable part by bonding the lower substrate 401 and the top substrate 430 thus provided via the above-mentioned procedure will be described.

Referring to FIG. 23A, a top surface of the lower substrate 401 provided via the processes of FIGS. 21A through 21D is coupled with a top substrate 430 formed thereunder with the contact member 450 and the pivot boss 470 via the processes of FIGS. 22A through 22D.

At this time, the surface where the contact member 450 and the pivot boss 470 are formed is coupled to a top surface of the top substrate 430, where the coupling can be accomplished, for example, by bonding operation.

Referring to FIG. 23B, the top substrate 430 is cut to a predetermined thickness.

Now, referring to FIG. 23C, the thickness-cut top substrate 430 is patterned by first and second elastic members 435*a* and 435*b*, a movable frame 431 and a movable electrode 433. A periphery where the contact member 450 is formed is also patterned to form a contact part 433*a*, and formation of a spring arm 433*b* is simultaneously conducted.

A switch manufactured through the above-mentioned process is created in bulk type such that a flatness of the structure is improved and a voltage loss caused by structure change can be solved.

Figure 24:
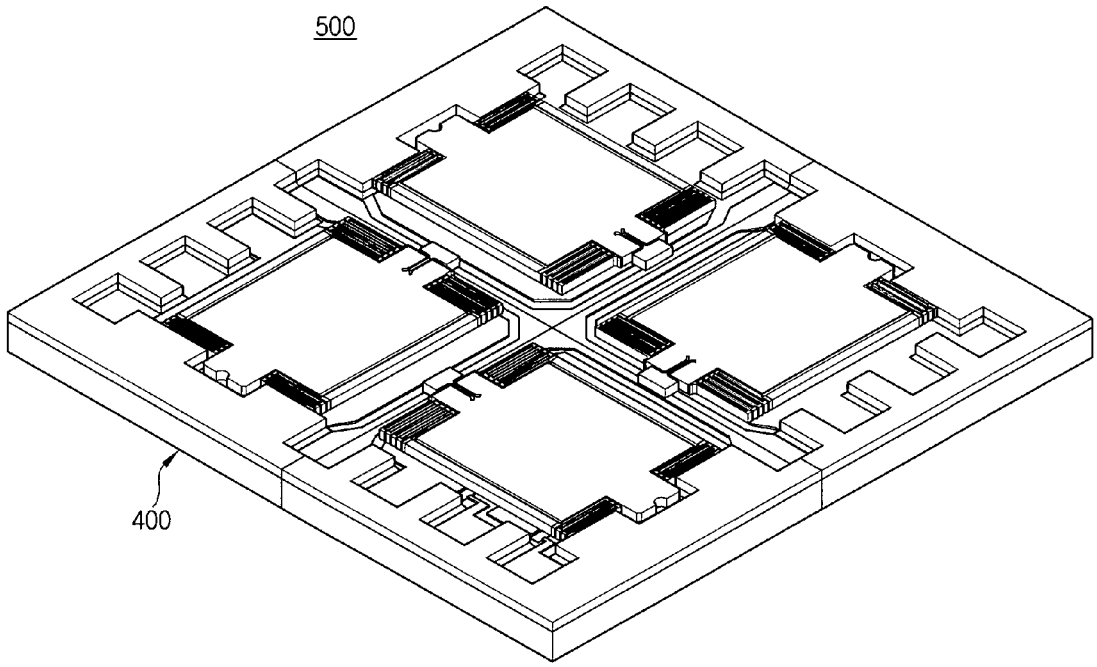
FIG. 24 is an exemplary drawing illustrating a structure of, for example, an SP4T switch by forming a plurality of MEMS switches of FIG. 14.
Figure 25:
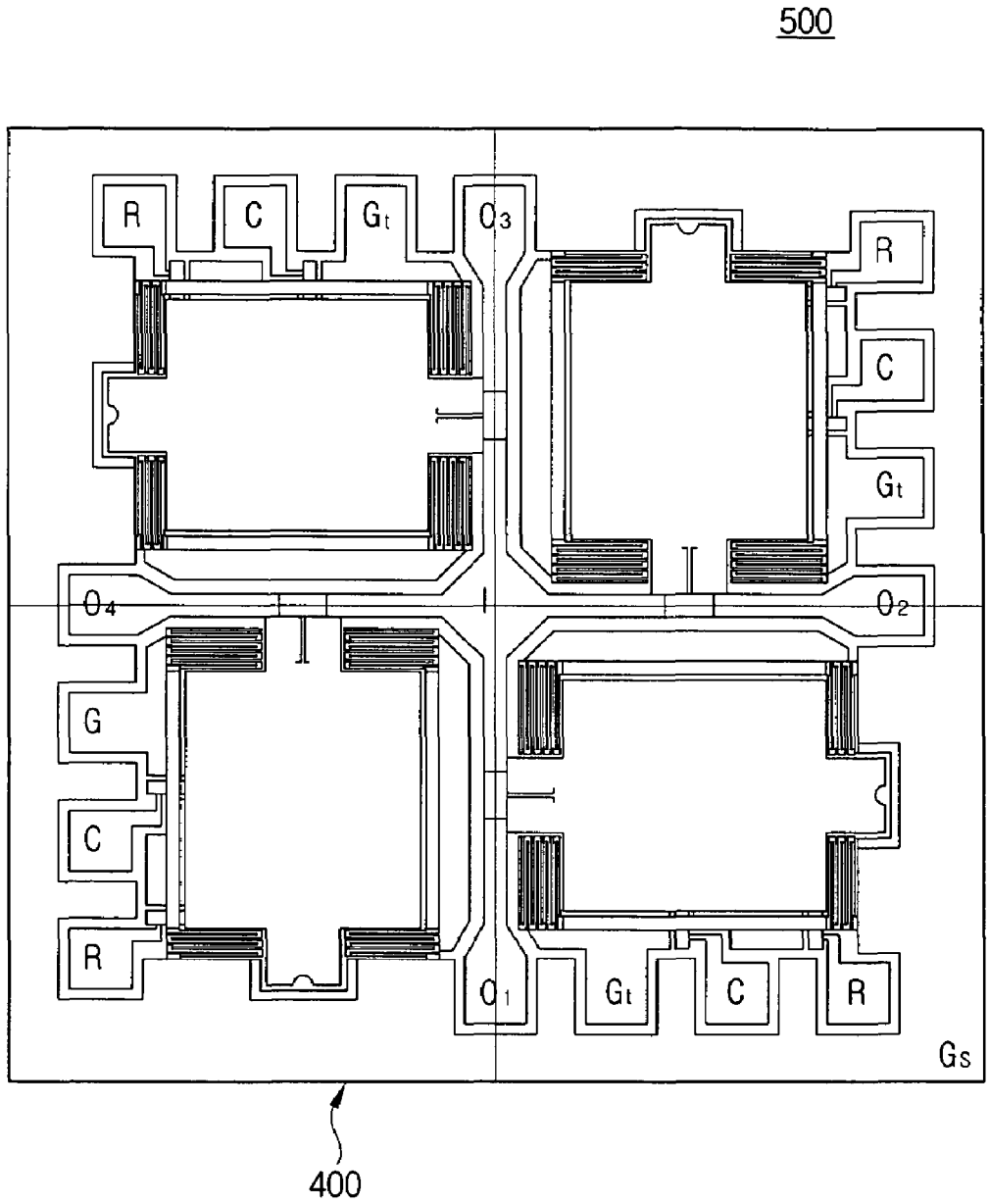
FIG. 25 is a plan view illustrating an electrically connected relation of the SP4T switch of FIG. 24.

FIG. 24 is an exemplary drawing illustrating a structure of, for example, an SP4T switch by forming a plurality of MEMS switches of FIG. 14, and FIG. 25 is a plan view illustrating an electrically connected relation of the SP4T switch of FIG. 24.

Referring to FIGS. 24 and 25, the above-mentioned bulk type MEMS switches are aligned in a two-row, two-line arrangement.

At this time, a signal input line (I) is centrally aligned with a cross shape, and four signal output lines ($O_1$, $O_2$, $O_3$ and $O_4$) are provided each spaced a predetermined distance apart relative to each distal end of the signal input line (I).

A reference letter Gt in FIG. 25 denotes a ground for transmitting a signal, C represents an area where a driving voltage is applied for turning on the switch, R means an area where a restoring voltage is applied for turning off the switch, and Gs is a ground for operating the switch.

The basic structure of SP4T is the same as that of FIG. 14, and that a manufacturing method thereof is similarly implemented as that of FIG. 14, such that a detailed description thereto is omitted.

As apparent from the foregoing, there is an advantage in the MEMS switch thus constructed according to an exemplary embodiment of the present invention in that basically the MEMS switch forms a seesaw configuration, and when a contact member is contacted, it constitutes a flat switch structure to thereby improve a contact force.

There is another advantage in that a pivot boss is used to turn off the switch by way of electrostatic restoring force with a small gap formed in the course of contact, thereby enabling to obtain a large restoring force even in a low voltage, whereby both the contact force and the restoring force can be increased regardless of assistance of a mechanical spring as electrostatic force can be increased if the voltage is increased.

There is still another advantage in that movable electrodes are made to rotate in dual-hinge structure, enabling to work in weak mechanical spring strength, and to decrease an initial pull-in voltage even with a bulk structure, and to minimize the influence of the mechanical spring during a switching operation using the pivot boss.

There is still further advantage in that it is manufactured by etching from a substrate, a different method from the existing method of stacking the layers, enabling to improve flatness and strength whereby a voltage loss and insufficient contact caused by a fine gap between electrodes can be solved.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A MEMS switch comprising:

a substrate;

at least one fixed electrode formed on top of the substrate;

at least one restoring electrode formed on top of the substrate and formed at a lateral surface of the fixed electrode;

at least one signal line formed on top of the substrate and having a switching contact part;

a movable electrode distantly connected from the top of the substrate at a predetermined space via an elastic connector on the substrate;

at least one contact member formed on a bottom surface of the movable electrode or on a bottom surface of the elastic connector for attachment to or detachment from the switching contact part; and at least one pivot boss formed on either the bottom surface of the movable electrode or on the top of the substrate, wherein the elastic connector comprises a movable frame constituting a pair of beams, each spaced a predetermined distance apart, having the movable electrode disposed therebetween.

2. The switch as defined in claim 1, wherein the elastic connector further comprises:

first elastic members for connecting one end of the beams to the substrate; and a second elastic member connecting a distal end of the movable electrode interposed in the pair of beams to the other end of the beams.

3. The switch as defined in claim 1, wherein the pivot boss is formed on the bottom surface of the movable electrode.

4. The switch as defined in claim 1, wherein the fixed electrode and the restoring electrode further comprise an insulation layer thereon.

5. The switch as defined in claim 4, wherein the insulation layer is SiN or SiO2.

6. The switch as defined in claim 1, wherein the fixed electrode, the restoring electrode and the signal line constitute Au.

7. The switch as defined in claim 1, wherein the contact member comprises:

a contact insulation layer formed on the bottom surface of the movable electrode or the bottom surface of the movable frame; and a contact conductive layer formed on a bottom surface of the contact insulation layer.

8. The switch as defined in claim 2, wherein the pivot boss is formed on the bottom surface of the movable electrode is interposed between the fixed electrode and the restoring electrode and is paired in parallel with the signal line.

9. The switch as defined in claim 2, wherein the contact member is rotatable about a spring arm formed at a distal end of the movable electrode in a direction perpendicularly crossing the signal line.

10. The switch as defined in claim 7, wherein the contact insulation layer is SiN or SiO2.

11. The switch as defined in claim 7, wherein the contact conductive layer is Au.

12. A MEMS switch comprising:

a substrate;

at least one fixed electrode formed on top of the substrate;

at least one restoring electrode formed on top of the substrate and formed at a lateral surface of the fixed electrode;

at least one signal line formed on top of the substrate and having a switching contact part;

a movable electrode distantly connected from the top of the substrate at a predetermined space via an elastic connector on the substrate;

at least one contact member formed on a bottom surface of the movable electrode or on a bottom surface of the elastic connector for attachment to or detachment from the switching contact part; and at least one pivot boss formed on either the bottom surface of the movable electrode or on the top of the substrate, wherein the elastic connector comprises:

a movable frame having a square frame for protruding one end of the movable electrode;

a first elastic member connecting one end of the movable frame to the substrate; and a second elastic member connecting one end of the movable electrode disposed inside the movable frame to the movable frame.

13. The switch as defined in claim 12, wherein the contact member is provided on the bottom surface of the movable frame.

14. The switch as defined in claim 12, wherein the contact member is provided on a distal end of the movable electrode.

15. A MEMS switch comprising:

a lower substrate formed thereon with a bottom electrode groove, and formed with at least one fixed electrode, a restoring electrode and a signal line having a signal contact part on the bottom electrode groove;

a top substrate including a movable frame traversing the fixed electrode and the restoring electrode, a first elastic member connected at one end thereof to one end of the movable frame and connected at the other end thereof to one side of the top substrate, a second elastic member formed at the other end of the movable frame, and a movable electrode connected to the second elastic member and relatively rotating inside the movable frame, the top substrate being integrally formed with the movable frame, the first elastic member, the second elastic member, and the movable electrode and contacting a top surface of the lower substrate corresponding to a periphery of the bottom electrode groove;

a contact member formed at a bottom surface of the movable frame; and a pivot boss formed at an approximate center of the movable electrode.

16. The switch as defined in claim 15, wherein the lower substrate is made of glass.

17. The switch as defined in claim 15, wherein the top substrate is made of silicon.

18. The switch as defined in claim 15, wherein the fixed electrode, the restoring electrode and the signal line are made of Au.

19. The switch as defined in claim 15, wherein the fixed electrode and the restoring electrode further comprise thereon an insulation layer.

20. The switch as defined in claim 19, wherein the insulation layer is formed with SiN layer or SiO2 layer.

21. The switch as defined in claim 15, wherein the contact member comprises:

a contact insulation layer formed on a bottom surface of the movable electrode; and a contact conductive layer formed on a bottom surface of the contact insulation layer.

22. The switch as defined in claim 21, wherein the contact insulation layer is SiN layer or SiO2 layer.

23. The switch as defined in claim 21, wherein the contact conductive layer is Au.

24. The switch as defined in claim 15, wherein the movable electrode is provided at a distal end thereof with a contact part having a size corresponding to that of the contact member, and the contact part is rotatably connected to a distal end of the movable electrode by a spring arm.

25. The switch as defined in claim 15, wherein the first elastic member and the second elastic member are serpentine in shape.

26. A manufacturing method of MEMS switch comprising:

forming a bottom electrode groove having a predetermined gap on a lower substrate;

forming at least one fixed electrode, at least one restoring electrode and at least one signal line having a signal contact part on a top surface of the bottom electrode groove;

forming a contact member and a pivot boss on a lower surface of a top substrate;

bonding the top substrate formed with the contact member and the pivot boss to a top surface of the lower substrate; and integrally forming a first elastic member, a movable frame, a second elastic member and a movable electrode on the top substrate bonded to the top surface of the lower substrate.

27. The method as defined in claim 26, wherein the lower substrate is a glass substrate.

28. The method as defined in claim 26, wherein the fixed electrode, the restoring electrode and the signal line are made of Au.

29. The method as defined in claim 26, wherein the top substrate is a silicon substrate.

30. The method as defined in claim 26, wherein the step of integrally forming the first elastic member, the movable frame, the second elastic member and the movable electrode on the top substrate further comprises:

forming a contact part formed with the contact member, and forming a spring arm hinge-fixing the contact part.

31. The method as defined in claim 26, wherein the first and second elastic members are serpentine in shape.

* * * * *